US008868013B2

(12) United States Patent
Choi et al.

(10) Patent No.: US 8,868,013 B2
(45) Date of Patent: Oct. 21, 2014

(54) APPARATUS AND METHOD FOR TRANSMITTING/RECEIVING SIGNAL

(75) Inventors: Jinkyu Choi, Daejeon (KR); Hyung-Jung Kim, Daejeon (KR); Seok Seo, Daejeon (KR); Jin-Up Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 629 days.

(21) Appl. No.: 12/888,216

(22) Filed: Sep. 22, 2010

(65) Prior Publication Data

US 2011/0092174 A1 Apr. 21, 2011

(30) Foreign Application Priority Data

Oct. 20, 2009 (KR) ..... 10-2009-0099964
Jun. 30, 2010 (KR) ..... 10-2010-0062836

(51) Int. Cl.
*H01Q 11/12* (2006.01)
*H01Q 1/24* (2006.01)

(52) U.S. Cl.
CPC ..... *H01Q 1/24* (2013.01)
USPC ..... 455/118; 455/76; 455/109

(58) Field of Classification Search
CPC ..... H04B 1/406; H04B 1/40; H04B 1/0003; H04B 1/0007; H04B 1/005; H04B 1/0458
USPC ..... 455/118
See application file for complete search history.

(56) References Cited

U.S. PATENT DOCUMENTS 5,430,711 A 7/1995 Yamada et al.
5,896,562 A * 4/1999 Heinonen ..... 455/76
2005/0191974 A1* 9/2005 Pan ..... 455/109
2009/0073029 A1* 3/2009 Nishijima et al. ..... 342/200
2009/0253385 A1* 10/2009 Dent et al. ..... 455/83

FOREIGN PATENT DOCUMENTS

JP H05-153182 A 6/1993
JP H05-252214 A 9/1993
JP H06-152675 A 5/1994
JP H06-318923 A 11/1994

OTHER PUBLICATIONS

Stephen Wu et al., "A 900-MHz/1.8-GHz CMOS Receiver for Dual-Band Applications", IEEE Journal of Solid-State Circuits, vol. 33, No. 12, pp. 2178-2185, Dec. 1998.
Marcus Windisch et al., "Adaptive I/Q Imbalance Compensation in Low-IF Transmitter Architectures", IEEE VTC, vol. 3, pp. 2096-2100, 2004.
Sidney Darlington, "On Digital Single-Sideband Modulators", IEEE Trans. on Circuit Theory, vol. 17, No. 3, pp. 409-414, Aug. 1970.

* cited by examiner

*Primary Examiner* — Ajibola Akinyemi
(74) *Attorney, Agent, or Firm* — Rabin & Berdo, P.C.

(57) ABSTRACT

A signal transmitting apparatus includes a signal distributor, a frequency converter, and a frequency synthesizer. The signal distributor is configured to baseband signals corresponding respectively to a plurality of frequency band. The frequency converter is configured to convert each of the distributed baseband signals into one of a positive frequency signal and a negative frequency signal according to the frequency band. The frequency synthesizer is configured to synthesize the positive frequency signal and the negative frequency signal to generate a transmission signal. Herein, the positive frequency signal and the negative frequency signal are signals included in one predetermined intermediate frequency band.

11 Claims, 18 Drawing Sheets

APPARATUS AND METHOD FOR TRANSMITTING/RECEIVING SIGNAL

CROSS-REFERENCE(S) TO RELATED APPLICATIONS

The present application claims priority of Korean Patent Application Nos. 10-2009-0099964 and 10-2010-0062836, filed on Oct. 20, 2009, and Jun. 30, 2010, respectively, which are incorporated herein by reference in their entirety.

BACKGROUND OF THE INVENTION

1. Field of the Invention

Exemplary embodiments of the present invention relate to a communication system; and, more particularly, to a signal transmitting apparatus and method for transmitting signals with different frequency bands.

2. Description of Related Art

In general, wireless communication systems define the standards for communication between a signal transmitting apparatus (or a transmitter) and a signal receiving apparatus (or a receiver). Therefore, the signal transmitting apparatus and the signal receiving apparatus have a predetermined frequency band for signal transmission.

Currently, a general wireless communication system uses one predetermined frequency band. For example, a Code Division Multiple Access (CDMA) communication system spreads signals by a random code prior to transmission. The CDMA communication system performs communication by using a predetermined frequency band. Also, an Orthogonal Frequency Division Multiplexing (OFDM) communication system transmits signals by using a plurality of subcarriers orthogonal to each other. The OFDM communication system may not use some of all the subcarriers. However, the OFDM communication system also has a predetermined frequency band for communication between a transmitting apparatus and a receiving apparatus.

In this manner, the conventional wireless communication systems transmit signals by using one radio frequency (RF) transmitter. However, a variety of next-generation wireless communication systems are to use various frequency bands (not a predetermined frequency band) for efficient use of limited frequency resources. An RF transmitter, which performs a radio signal processing operation for signal transmission through an antenna, can perform a radio signal processing operation only in a limited frequency band.

Thus, the next-generation wireless communication systems, which use a plurality of frequency bands (not a specific frequency band), must have additional RF transmitters corresponding to a plurality of frequency bands in order to communicate signals.

SUMMARY OF THE INVENTION

An embodiment of the present invention is directed to a signal transmitting apparatus and method that can transmit signals with a plurality of frequency bands through one radio frequency (RF) transmitter.

Another embodiment of the present invention is directed to a signal transmitting apparatus and method that can reduce the number of RF transmitters necessary to transmit signals with a plurality of frequency bands.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, a signal transmitting apparatus includes: a signal distributor configured to baseband signals corresponding respectively to a plurality of frequency bands; a frequency converter configured to convert each of the distributed baseband signals into one of a positive frequency signal and a negative frequency signal according to the frequency band; and a frequency synthesizer configured to synthesize the positive frequency signal and the negative frequency signal to generate a transmission signal, wherein the positive frequency signal and the negative frequency signal are signals included in one predetermined intermediate frequency band.

The signal transmitting apparatus may further include a radio transmitter configured to convert the transmission signal into a radio signal prior to transmission, wherein the radio transmitter supports the transmission of a signal of the intermediate frequency band.

The frequency converter may include: a positive frequency converting unit configured to convert a portion of the distributed baseband signals into a positive frequency signal included in a positive frequency region; and a negative frequency converting unit configured to convert the other portion of the distributed baseband signals into a negative frequency signal included in a negative frequency region The frequency synthesizer may include: a signal synthesizing unit configured to synthesize the positive frequency signal and the negative frequency signal; and an intermediate frequency converting unit configured to convert the positive frequency signal and the negative frequency signal to a second intermediate frequency region different from the intermediate frequency region.

The signal transmitting apparatus may further include a radio transmitter configured to convert the transmission signal into a radio signal prior to transmission, wherein the radio transmitter supports the transmission of a signal of the second intermediate frequency band.

The signal distributor may distribute each of the baseband signals to one of the positive frequency converting unit and the negative frequency converting unit.

The signal distributor may select and distribute one of the baseband signals.

The frequency converter may further include a switch configured to provide the selected baseband signal to the frequency synthesizer.

The frequency synthesizer may include: a signal synthesizing unit configured to convert the provided baseband signal into a center frequency signal included in a center frequency region and to synthesize the positive frequency signal, the center frequency signal and the negative frequency signal; and an intermediate frequency converting unit configured to convert the positive frequency signal, the center frequency signal and the negative frequency signal to a second intermediate frequency region different from the intermediate frequency band, wherein the center frequency signal is included in the intermediate frequency band.

In accordance with another embodiment of the present invention, a signal transmitting apparatus includes: a negative frequency signal generating unit configured to generate a first baseband signal as a first negative frequency signal and a second negative frequency signal by operation with a first sine signal and a first cosine signal for conversion to a negative frequency region signal of an intermediate frequency band; a positive frequency signal generating unit configured to generate a second baseband signal as a first positive frequency signal and a second positive frequency signal by operation with a second sine signal and a second cosine signal for conversion to a positive frequency region signal of an intermediate frequency band; a rate matching unit configured to rate-match each of the first and second negative frequency signals and to rate-match each of the first and second positive frequency signals; a signal combining unit configured to generate a first frequency synthesis signal by subtracting the rate-matched first positive frequency signal from the rate-matched first negative frequency signal, and to generate a second frequency synthesis signal by adding the rate-matched second positive frequency signal to the rate-matched second negative frequency signal; and an intermediate frequency converting unit configured to generate a first intermediate frequency signal by multiplying the first frequency synthesis signal by a third sine signal for conversion to a signal of a second intermediate frequency band different from the intermediate frequency band, and to generate a second intermediate frequency signal by multiplying the first frequency synthesis signal by a third cosine signal, wherein the first baseband signal and the second baseband signal are signals of different frequency bands.

The negative frequency signal generating unit may include: first multipliers configured to multiply a first in-phase signal of a first baseband signal respectively by a first cosine signal and a first sine signal; second multipliers configured to multiply a first quadrature-phase signal of the first baseband signal respectively by the first sine signal and the first cosine signal; a first combiner configured to generate a first negative frequency signal by subtracting the first quadrature-phase signal multiplied by the first sine signal from the first in-phase signal multiplied by the first cosine signal; and a second combiner configured to generate a second negative frequency signal by adding the first in-phase signal multiplied by the first sine signal and the first quadrature-phase signal multiplied by the first cosine signal.

The negative frequency signal generating unit may include: third multipliers configured to multiply a second in-phase signal of a second baseband signal respectively by a second cosine signal and a second sine signal; fourth multipliers configured to multiply a second quadrature-phase signal of the second baseband signal respectively by the second sine signal and the second cosine signal; a third combiner configured to generate a first positive frequency signal by subtracting the second quadrature-phase signal multiplied by the second sine signal from the second in-phase signal multiplied by the second cosine signal; and a fourth combiner configured to generate a second positive frequency signal by adding the second in-phase signal multiplied by the second sine signal and the second quadrature-phase signal multiplied by the second cosine signal.

In accordance with another embodiment of the present invention, a signal transmitting apparatus includes: a negative frequency signal generating unit configured to generate a first baseband signal as a first negative frequency signal and a second negative frequency signal by operation with a first sine signal and a first cosine signal for conversion to a negative frequency region signal of an intermediate frequency band; a positive frequency signal generating unit configured to generate a second baseband signal as a first positive frequency signal and a second positive frequency signal by operation with a second sine signal and a second cosine signal for conversion to a positive frequency region signal of an intermediate frequency band; a rate matching unit configured to rate-match each of the first and second negative frequency signals and to rate-match each of the first and second positive frequency signals; and a signal combining unit configured to generate a first frequency synthesis signal by adding the rate-matched first positive frequency signal to the rate-matched first negative frequency signal, and to generate a second frequency synthesis signal by subtracting the rate-matched second positive frequency signal from the rate-matched second negative frequency signal, wherein the first baseband signal and the second baseband signal are signals of different frequency bands.

The negative frequency signal generating unit may include: a first polar modulating unit configured to generate a first amplitude signal and a first phase signal by polar-modulating a first in-phase signal of a first baseband signal and a first quadrature-phase signal; a first cosine transform unit configured to transform the first phase signal into a first cosine signal; a first sine transform unit configured to transform the first phase signal into a first sine signal; first multipliers configured to multiply the first cosine signal respectively by a second cosine signal and a second sine signal; second multipliers configured to multiply the first sine signal respectively by the second sine signal and the second cosine signal; a first combiner configured to subtract the first cosine signal multiplied by the second sine signal from the first cosine signal multiplied by the second sine signal; a second combiner configured to add the first sine signal multiplied by the second cosine signal to the first sine signal multiplied by the second sine signal; a first multiplier configured to generate a first negative frequency signal by multiplying the output signal of the first combiner by the first amplitude signal; and a second multiplier configured to generate a second negative frequency signal by multiplying the output signal of the second combiner by the first amplitude signal.

The positive frequency signal generating unit may include: a second polar modulating unit configured to generate a second amplitude signal and a second phase signal by polar-modulating a second in-phase signal of a second baseband signal and a second quadrature-phase signal; a second cosine transform unit configured to transform the second phase signal into a third cosine signal; a second sine transform unit configured to transform the second phase signal into a third sine signal; third multipliers configured to multiply the third cosine signal respectively by a fourth cosine signal and a fourth sine signal; fourth multipliers configured to multiply the third sine signal respectively by the fourth sine signal and the fourth cosine signal; a third combiner configured to subtract the third cosine signal multiplied by the fourth sine signal from the third cosine signal multiplied by the fourth cosine signal; a fourth combiner configured to add the third sine signal multiplied by the fourth cosine signal to the third sine signal multiplied by the fourth sine signal; a third multiplier configured to generate a first positive frequency signal by multiplying the output signal of the fourth combiner by the second amplitude signal; and a fourth multiplier configured to generate a second positive frequency signal by multiplying the output signal of the second combiner by the second amplitude signal.

In accordance with another embodiment of the present invention, a signal transmitting method of a transmitting apparatus includes: converting each of baseband signals corresponding respectively to a plurality of frequency bands into one of a positive frequency region signal and a negative frequency region signal; synthesizing the positive frequency region signal and the negative frequency region signal to generate a transmission signal; and transmitting the transmission signal, wherein the positive frequency region signal and the negative frequency region signal are signals of one predetermined intermediate frequency band.

The intermediate frequency band may be a frequency band that is supported by a radio frequency (RF) transmitter that converts the transmission signal into a radio signal prior to transmission.

In said transmitting the transmission signal, the transmission signal may be transmitted by frequency-converting the synthesized signal of the positive frequency signal and the negative frequency signal to a second intermediate frequency band different from the intermediate frequency band.

The second intermediate frequency band may be a radio frequency band that is supported by a radio frequency (RF) transmitter that converts the transmission signal into a radio signal prior to transmission.

The signal transmitting method may further include converting the selected baseband signal into a center frequency region signal, wherein the center frequency region signal is a signal of the intermediate frequency band.

DESCRIPTION OF SPECIFIC EMBODIMENTS

Figure 1:
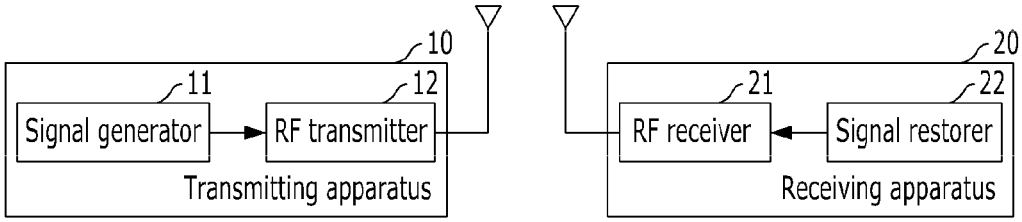
FIG. 1 is a block diagram of a wireless communication system in accordance with an exemplary embodiment of the present invention.

Exemplary embodiments of the present invention will be described below in more detail with reference to the accompanying drawings. The present invention may, however, be embodied in different forms and should not be constructed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

Hereinafter, exemplary embodiments of the present invention will be described in detail with reference to the accompanying drawings. In the following description, detailed descriptions of well-known functions or configurations will be omitted in order not to unnecessarily obscure the subject matters of the present invention.

The present invention provides a signal transmitting apparatus and method that transmits signals with different frequency bands (or bandwidths) in a wireless communication system by using one radio frequency (RF) transmitter.

FIG. 1 is a block diagram of a wireless communication system in accordance with an exemplary embodiment of the present invention.

Referring to FIG. 1, a wireless communication system in accordance with an exemplary embodiment of the present invention includes a transmitting apparatus 10 and a receiving apparatus 20.

The transmitting apparatus 10 transmits wireless signals. The transmitting apparatus 10 includes a signal generator 11 and a radio frequency (RF) transmitter 12.

The signal generator 11 generates a transmission (TX) signal from a baseband signal generated by the transmitting apparatus 10.

The RF transmitter 12 converts the TX signal into a radio signal. The RF transmitter 12 may include an antenna for radio signal transmission, and transmits the radio signal through the antenna. The RF transmitter 12 may include a radio signal generating circuit (e.g., an automatic gain controller (AGC)), a power amplifier (PA), and a band-pass filter (BPF).

The receiving apparatus 20 receives the radio signal transmitted from the transmitting apparatus 10.

The receiving apparatus 20 includes a radio frequency (RF) receiver 21 and a signal restorer 22.

The RF receiver 21 may include an antenna for radio signal reception. The RF receiver 21 receives a radio signal through the antenna. The RF receiver 21 may include a radio signal receiving circuit (e.g., a low-noise amplifier (LNA) and a band-pass filter (BPF)).

The signal restorer 22 restores the TX signal, transmitted by the transmitting apparatus 10, from the radio signal.

The signal generator 11 and the signal restorer 22 may each include a baseband unit that generates or restores a baseband signal.

In general, the RF transmitter 12 transmits a signal with one frequency band (or bandwidth). If the transmitting apparatus 10 is to transmit baseband signals with different frequency bands, it needs to have additional RF transmitters that respectively support the different frequency bands.

For generation of a TX signal, the signal generator generates baseband signals in one predetermined intermediate frequency (IF) band. Thus, because the signal generator 11 generates baseband signals of different frequency bands in one IF band, the transmitting apparatus 10 needs only one RF transmitter 12 for signal transmission.

Hereinafter, a detailed description will be given of the signal generator 11 that makes it possible to use only one RF transmitter 12 as described above.

Figure 2:
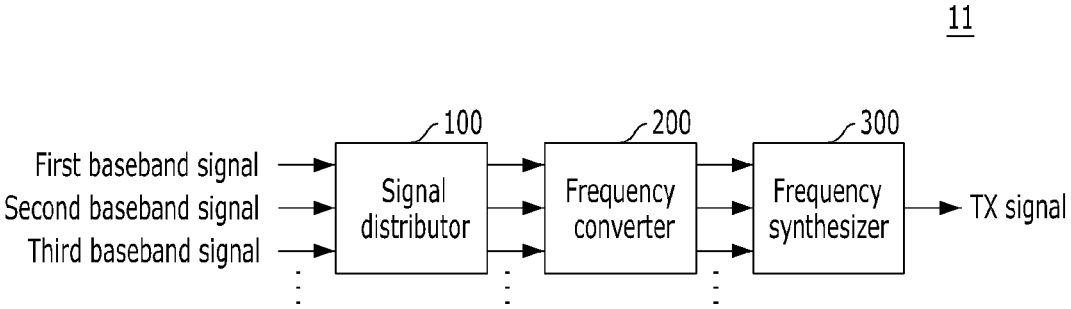
FIG. 2 is an exemplary block diagram of a signal generator illustrated in FIG. 1.

FIG. 2 is an exemplary block diagram of the signal generator 11 illustrated in FIG. 1.

Referring to FIG. 2, the signal generator 11 includes a signal distributor 100, a frequency converter 200, and a frequency synthesizer 300.

The signal distributor 100 distributes received baseband signals for transmission through a positive frequency domain or a negative frequency domain. The signal distributor 100 may distribute signals so that baseband signals are transmitted through a center frequency domain. Also, according to an operation mode of the transmitting apparatus 10, the signal distributor 100 may distribute one baseband signal (in a single frequency band transmission mode) or may distribute a plurality of baseband signals (in a multiple frequency band transmission mode).

The frequency converter 200 performs a frequency conversion operation so that each of the baseband signals distributed by the signal distributor 100 is transmitted through a positive frequency domain or a negative frequency domain. Herein, the signal included in the positive frequency domain and the signal included in the negative frequency domain are included in one predetermined intermediate frequency (IF) band.

The frequency synthesizer 300 generates a transmission (TX) signal by synthesizing the positive frequency domain signal and the negative frequency domain signal outputted from the frequency converter 200. The frequency synthesizer 300 provides the TX signal to the RF transmitter 12. Herein, the TX signal is a signal of one frequency band, for example, an IF band.

The signal distributor 100, the frequency converter 200, and the frequency synthesizer 300 may operate under the control of a control unit (not illustrated) included in the transmitting apparatus 10.

Figure 3:
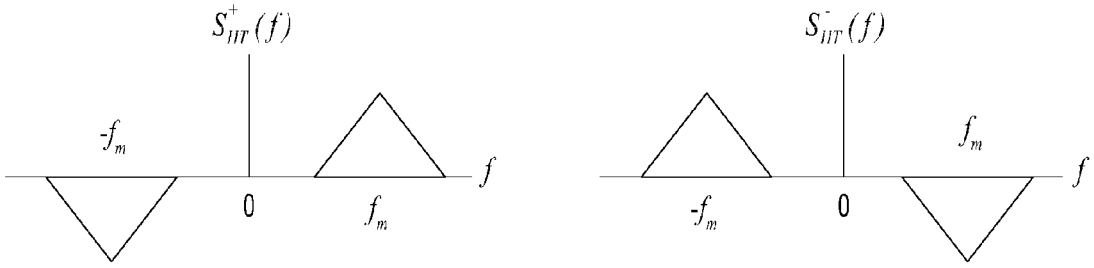
FIG. 3 is a diagram illustrating an exemplary operation of generating a transmission (TX) signal by a frequency converter illustrated in FIG. 2.

FIG. 3 is a diagram illustrating an exemplary operation of generating a transmission (TX) signal by the frequency converter 200 illustrated in FIG. 2.

Referring to FIG. 3, the frequency converter 200 generates a signal of a predetermined intermediate frequency (IF) band. The frequency converter 200 generates frequency signals $S^{+}_{HT}(f)$ $S^{-}_{HT}(f)$) opposite signs between a signal of a positive frequency domain and a signal of a negative frequency domain. Herein, the frequency signals $S^{+}_{HT}(f)$ and $S^{-}_{HT}(f)$) generated by the frequency converter 200 are expressed as Equation 1.

$$S^{+}_{HT}(f) = \begin{cases} S_{+}(f), & f > 0 \\ 0, & f = 0 \\ -S_{-}(f), & f < 0 \end{cases} \qquad \text{Eq. 1}$$

-continued $$S^{-}_{HT}(f) = \begin{cases} -S_{+}(f), & f > 0 \\ 0, & f = 0 \\ S_{-}(f), & f < 0 \end{cases}$$

The frequency signals $S^{+}_{HT}(f)$ and $S^{-}_{HT}(f)$) of Equation 1 may be generated by a control unit (not illustrated) and provided to the frequency converter 200.

The frequency converter 200 adds a frequency signal, the frequency response of which is defined by Equation 1, to a baseband signal (S(f) ($S_{+}(f)$+($S_{-}(f)$)) inputted to the signal generator 11. By using the frequency signal, the frequency converter 200 may convert the inputted baseband signal S(f) into a signal whose frequency response is present only in the frequency band of one of a positive frequency signal and a negative frequency signal. The baseband signal converted into one frequency band is expressed as Equation 2.

$$S_{+}(f)=S(f)+S^{+}_{HT}(f)$$

$$S_{-}(f)=S(f)+S^{-}_{HT}(f) \qquad \text{Eq. 2}$$

According to Equation 2, the frequency converter 200 may combine one frequency signal S(f) with each of the frequency signals of Equation 1 to generate a positive frequency domain signal $S_{+}(f)$ and a negative frequency domain signal $S_{-}(f)$.

Equation 2 is to describe the concept of the present invention on the basis of one frequency band signal. However, the frequency converter 200 may perform a frequency conversion operation on a plurality of baseband signals so that the frequency response is present only in the frequency band of one of a positive frequency signal and a negative frequency signal. Therefore, in the frequency converter 200 each of the baseband signals with different frequency bands is allocated to one of the positive frequency domain and the negative frequency domain.

Figure 4:
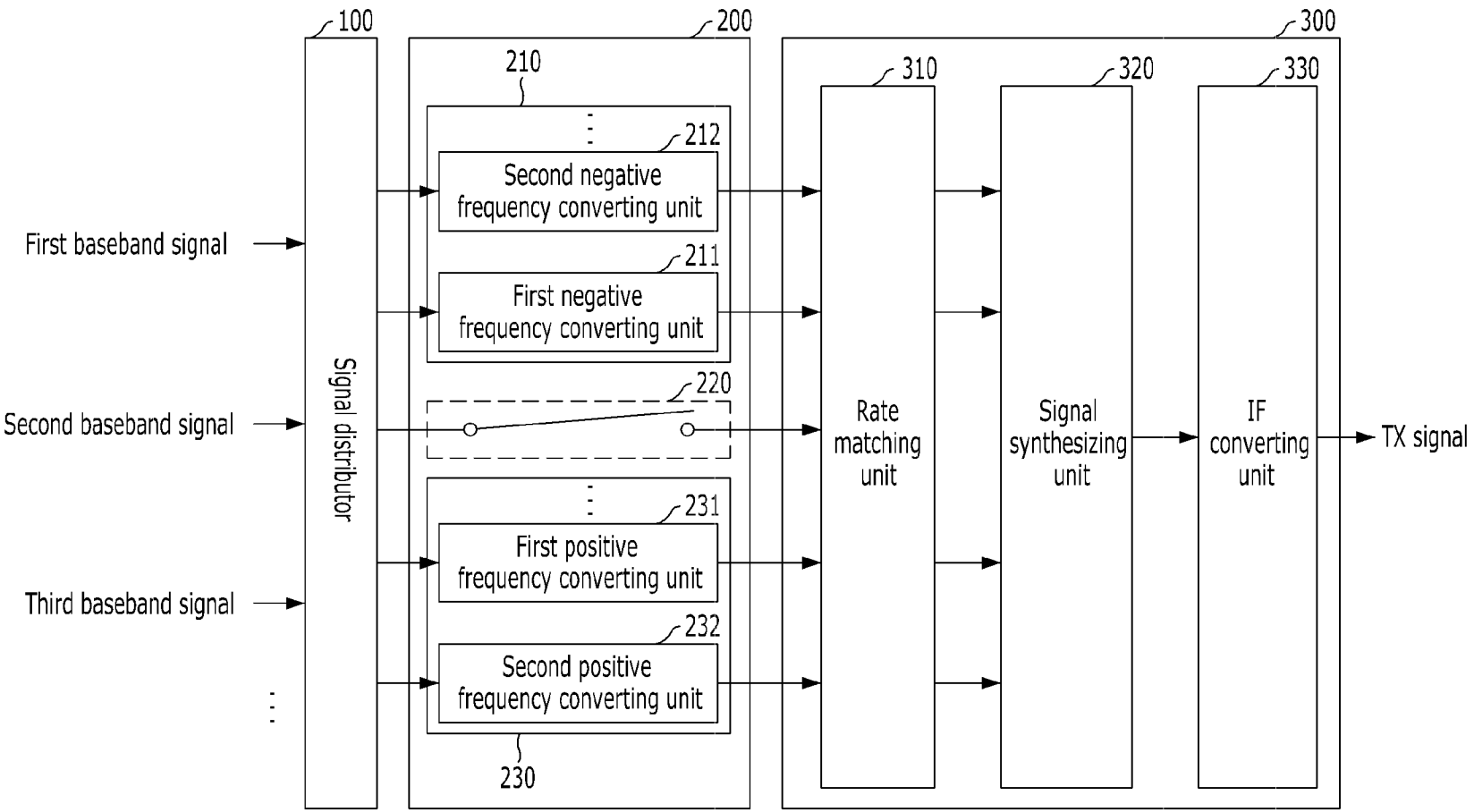
FIG. 4 is a block diagram of a signal generator in accordance with an exemplary embodiment of the present invention.

FIG. 4 is a block diagram of a signal generator 11 in accordance with an exemplary embodiment of the present invention.

Referring to FIG. 4, the signal generator 11 includes a signal distributor 100, a frequency converter 200, and a frequency synthesizer 300. The frequency converter 200 includes a negative frequency converting unit 210, a matching switch 220, and a positive frequency converting unit 230. The frequency synthesizer 300 includes a rate matching unit 310 and a signal synthesizing unit 320.

The signal distributor 100 receives baseband signals, and distributes the received baseband signals according to the respective frequency bands.

The frequency converter 200 allocates the respective baseband signals with different frequency bands to one of the positive frequency region and negative frequency region on the basis of one intermediate frequency, as described with reference to FIG. 3.

The negative frequency converting unit 210 generates a negative frequency signal from the baseband signal, distributed by the signal distributor 100, on the basis of one intermediate frequency. The negative frequency converting unit 210 may include a first negative frequency converting unit 211 and a second negative frequency converting unit 212. The first negative frequency converting unit 211 and the second negative frequency converting unit 212 respectively generate negative frequency signals that do not overlap each other in the negative frequency domain.

The matching switch 220 provides a baseband signal to the frequency synthesizer 300 in order to control the sampling rate between a plurality of baseband signals. The matching switch 220 may provide the baseband signal to the frequency synthesizer 300 in response to a switch control signal SW_CTRL provided by a control unit in the transmitting apparatus 10.

The positive frequency converting unit 230 generates a positive frequency signal from the baseband signal, distributed by the signal distributor 100, on the basis of one intermediate frequency. The positive frequency converting unit 230 may include a first positive frequency converting unit 231 and a second positive frequency converting unit 232. The first positive frequency converting unit 231 and the second positive frequency converting unit 232 respectively generate positive frequency signals that do not overlap each other in the positive frequency domain.

The frequency synthesizer 300 synthesizes positive frequency signals and negative frequency signals to generate a transmission (TX) signal.

The rate matching unit 310 performs a rate matching operation between the negative frequency signal and the positive frequency signal that are respectively outputted from the negative frequency converting unit 210 and the positive frequency converting unit 230. Also, the rate matching unit 310 may perform a rate matching operation on the negative frequency signal divided into an in-phase signal and a quadrature-phase signal, or may perform a rate matching operation on the positive frequency signal divided into an in-phase signal and a quadrature-phase signal.

The rate matching unit 310 may provide different data rates between the negative frequency signals and the positive frequency signals generated from the baseband signals of different frequency bands. In this manner, the rate matching unit 310 performs a rate matching operation for combining the negative frequency signals and the positive frequency signals that have different data rates.

The rate matching unit 310 may receive the baseband signal for rate matching through the matching switch 220 in order to perform the rate matching operation.

Also, the rate matching unit 310 may perform a rate matching operation between the quadrature-phase (Q) component and the in-phase (I) component of each baseband signal.

The signal synthesizing unit 320 synthesizes the rate-matched signals to generate one transmission (TX) signal. Herein, the TX signal is a signal of a predetermined intermediate frequency (IF) band. The TX signal includes baseband signals of different frequency bands in each of the positive frequency domain and negative frequency domain.

The signal synthesizing unit 320 provides the generated TX signal to the RF transmitter 12.

Figure 5:
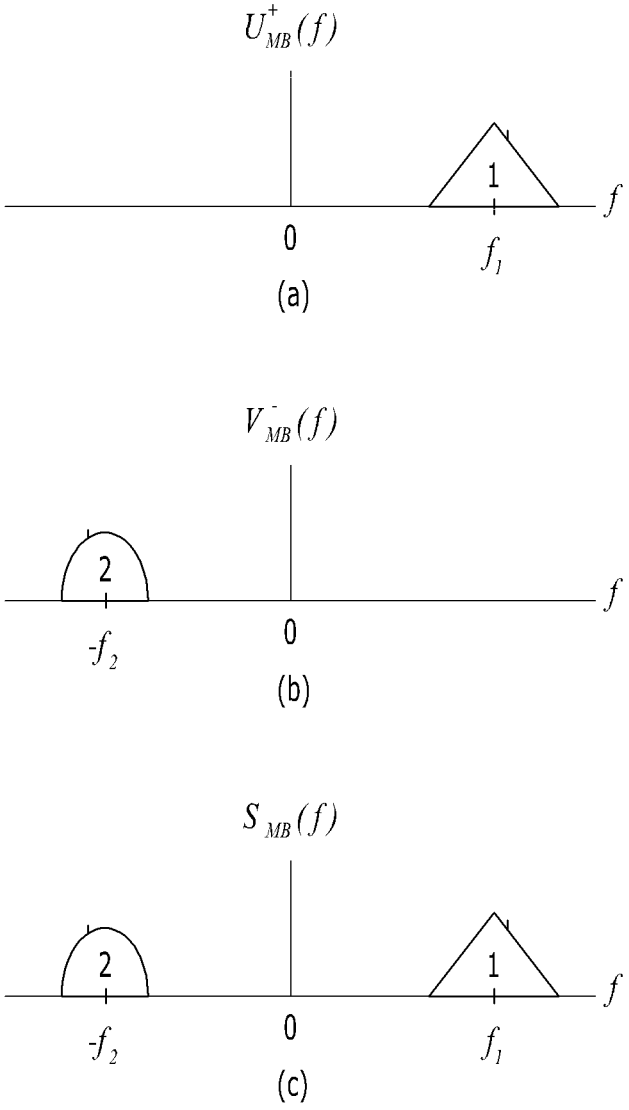
FIG. 5 is a diagram illustrating an example of TX signal generation according to the operation of the signal generator illustrated in FIG. 4.

FIG. 5 is a diagram illustrating an example of TX signal generation according to the operation of the signal generator 11 illustrated in FIG. 4.

Referring to FIG. 5, (*a*), (*b*) and (*c*) illustrate that the signal generator 11 converts two baseband signals into one IF band and generates a transmission (TX) signal. In (a), (b) and (c), the axis of abscissas represents a frequency f.

A TX signal generating operation will be described below on the basis of the signal generator 11 illustrated in FIG. 4.

The signal distributor 100 receives a first baseband signal and a second baseband signal that have different frequency bands. The signal distributor 100 distributes the first baseband signal to the first positive frequency converting unit 231 and distributes the second baseband signal to the first negative frequency converting unit 211.

The first positive frequency converting unit 231 converts the first baseband signal into a positive frequency signal 1 corresponding to an intermediate frequency $f_1$. The first baseband signal converted into the positive frequency signal 1 is illustrated in (a).

The first negative frequency converting unit 211 converts the second baseband signal into a negative frequency signal 2 corresponding to an intermediate frequency $-f_2$. The second baseband signal converted into the negative frequency signal 2 is illustrated in (b).

Herein, the positive frequency signal 1 and the negative frequency signal 2 are signals included in one intermediate frequency (IF) band.

The rate matching unit 310 rate-matches the positive frequency signal 1 and the negative frequency signal 2 and outputs the resulting signals to the signal synthesizing unit 320.

The signal synthesizing unit 320 generates a transmission (TX) signal by synthesizing the positive frequency signal 1 and the negative frequency signal 2 on the basis of a center frequency. The TX signal generated by synthesizing the positive frequency signal 1 and the negative frequency signal 2 is illustrated in (c).

Figure 6:
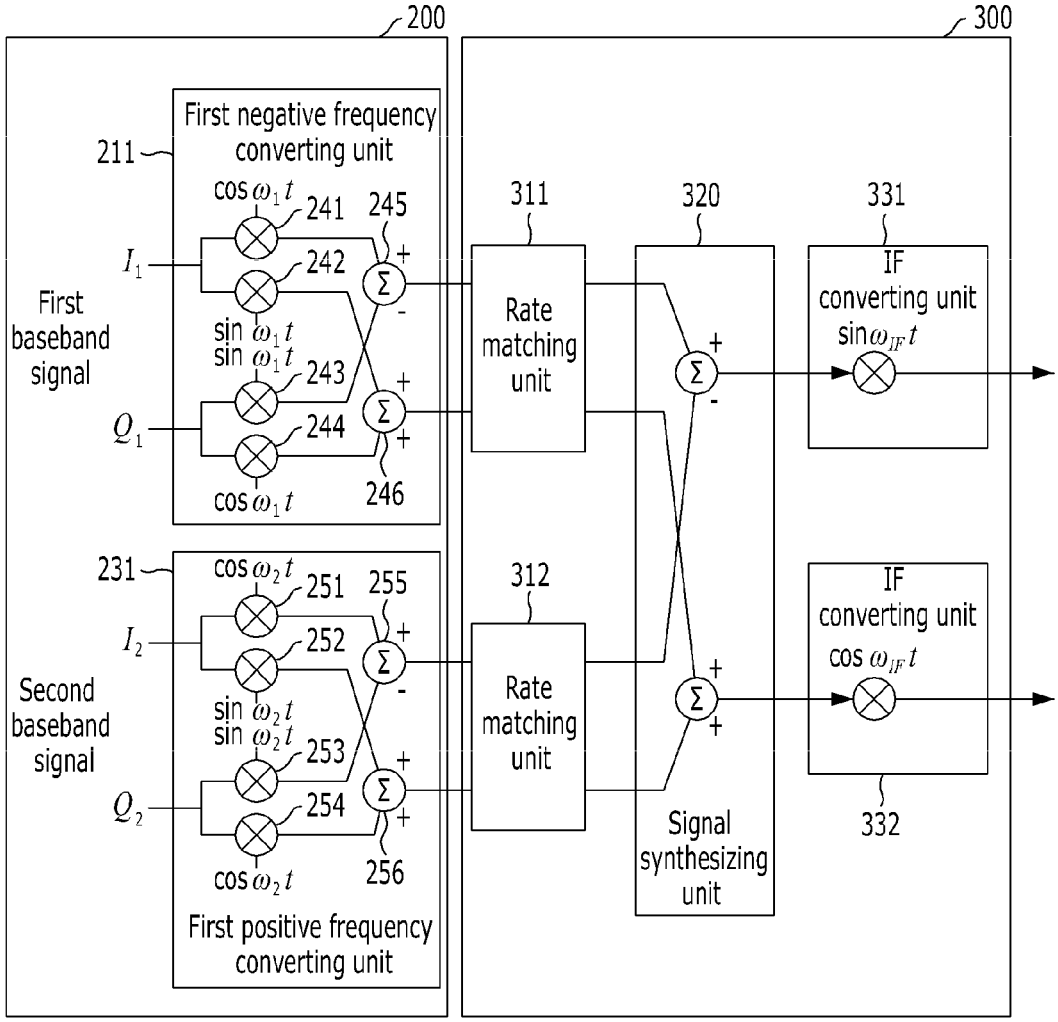
FIG. 6 is a block diagram of a signal generator in accordance with another exemplary embodiment of the present invention.

FIG. 6 is a block diagram of a signal generator 11 in accordance with another exemplary embodiment of the present invention.

Referring to FIG. 6, the signal generator 11 includes a signal distributor 100, a frequency converter 200, and a frequency synthesizer 300. The frequency converter 200 includes a negative frequency converting unit 210, a matching switch 220, and a positive frequency converting unit 230. The frequency synthesizer 300 includes a rate matching unit 310, a signal synthesizing unit 320, and an intermediate frequency (IF) converting unit 330.

The signal generator 11 additionally includes the intermediate frequency (IF) converting unit 330 in the frequency synthesizer 300. For example, if the transmitting apparatus 10 fails to support a sufficient operation speed, a frequency converting operation of the frequency converter 200 may fail to acquire a TX signal of a desired IF band (i.e., an IF band supported by the RF transmitter 12). In this context, the signal generator 11 may perform a frequency conversion operation to a desired IF band by using the IF converting unit 330. Thus, the signal generator 11 performs two IF conversion operations through the frequency converter 200 and the IF converting unit 330. The operation of the signal generator 11 for performing two IF conversion operations will be described below in detail.

The signal distributor 100 receives baseband signals, and distributes the received baseband signals according to the respective frequency bands.

The frequency converter 200 allocates the respective baseband signals with different frequency bands to each of the positive frequency region and negative frequency region on the basis of one intermediate frequency, as described with reference to FIG. 3.

The negative frequency converting unit 210 generates a negative frequency signal from the baseband signal, distributed by the signal distributor 100, on the basis of a first intermediate frequency. The negative frequency converting unit 210 may include a first negative frequency converting unit 211 and a second negative frequency converting unit 212. The first negative frequency converting unit 211 and the second negative frequency converting unit 212 respectively generate negative frequency signals that do not overlap each other in the negative frequency domain.

The matching switch 220 provides a baseband signal to the frequency synthesizer 300 in order to control the sampling rate between a plurality of baseband signals. The matching switch 220 may provide the baseband signal to the frequency synthesizer 300 in response to a switch control signal SW_CTRL provided by a control unit in the transmitting apparatus 10.

The positive frequency converting unit 230 generates a positive frequency signal from the baseband signal, distributed by the signal distributor 100, on the basis of a first intermediate frequency. The positive frequency converting unit 230 may include a first positive frequency converting unit 231 and a second positive frequency converting unit 232. The first positive frequency converting unit 231 and the second positive frequency converting unit 232 respectively generate positive frequency signals that do not overlap each other in the positive frequency domain.

The frequency synthesizer 300 synthesizes positive frequency signals and negative frequency signals to generate a transmission (TX) signal.

The rate matching unit 310 performs a rate matching operation between the negative frequency signal and the positive frequency signal that are respectively outputted from the negative frequency converting unit 210 and the positive frequency converting unit 230. The detailed operation of the rate matching unit 310 is the same as described with reference to FIG. 4, and thus a detailed description thereof will be omitted for conciseness.

The signal synthesizing unit 320 synthesizes the rate-matched signals to generate a signal of a first IF band. The TX signal includes baseband signals of different frequency bands in each of the positive frequency domain and negative frequency domain. The signal synthesizing unit 320 provides the first IF band signal to the IF converting unit 330.

The IF converting unit 330 converts the first IF band signal into a second IF band signal. For example, if the transmitting apparatus 10 fails to support a sufficient operation speed, the IF converting unit 330 may convert the frequency of a TX signal by converting to a signal of a second center frequency band supported by the RF transmitter 12, from the first center frequency converted by the frequency converter 200.

The IF converting unit 330 generates a TX signal converted to the second center frequency from the first center frequency signal. The IF converting unit 330 provides the generated TX signal to the RF transmitter 12.

Figure 7:
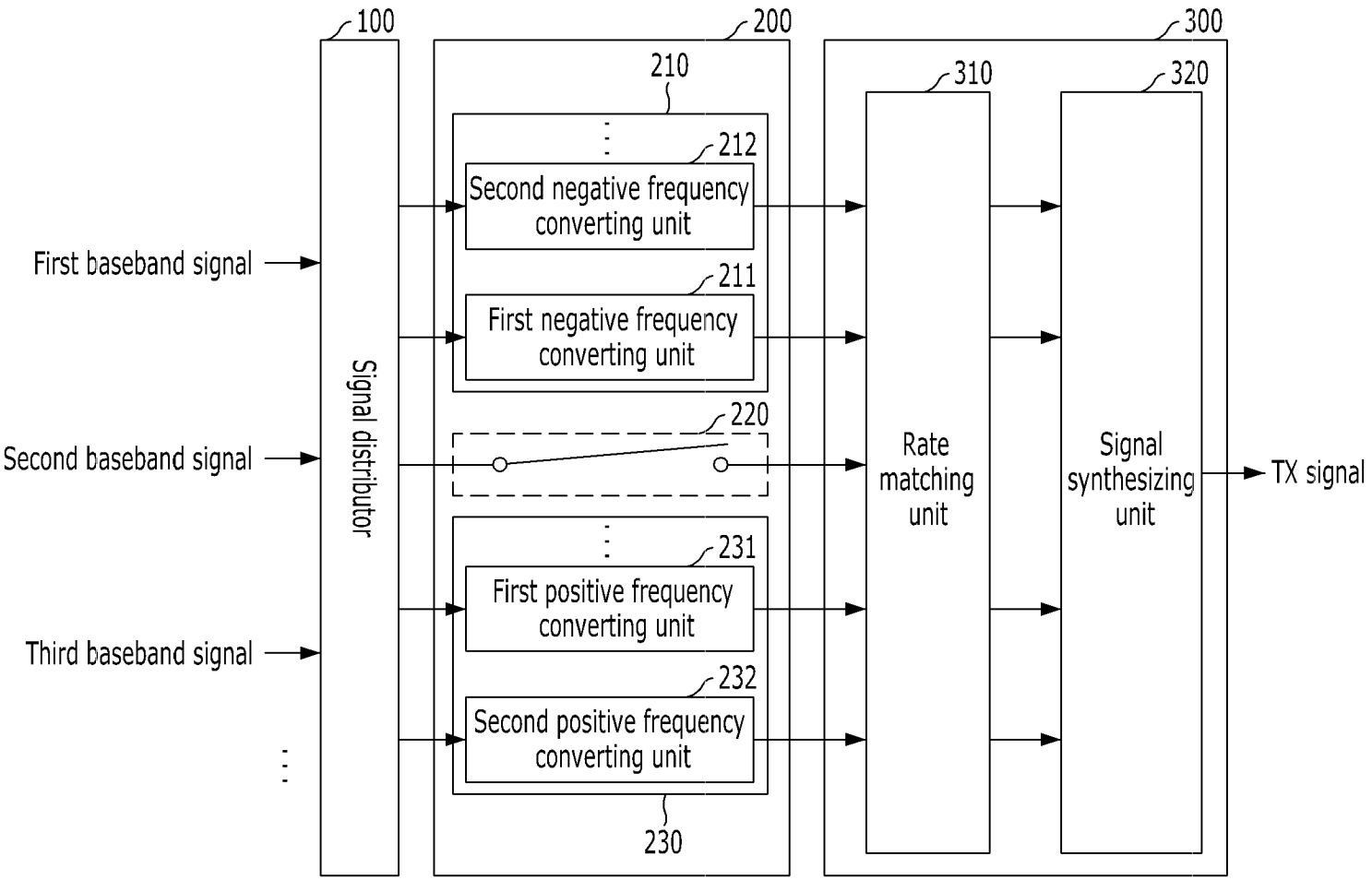
FIG. 7 is a diagram illustrating an example of TX signal generation according to the operation of the signal generator illustrated in FIG. 6.

FIG. 7 is a diagram illustrating an example of TX signal generation according to the operation of the signal generator 11 illustrated in FIG. 6.

Referring to FIG. 7, (*a*), (*b*), (*c*) and (*d*) illustrate that the signal generator 11 converts two baseband signals into a first IF band and converts the resulting signals into a second IF band to generate a transmission (TX) signal. In (a), (b), (c) and (d), the axis of abscissas represents a frequency f.

A TX signal generating operation will be described below on the basis of the signal generator 11 illustrated in FIG. 6.

The signal distributor 100 receives a first baseband signal and a second baseband signal that have different frequency bands. The signal distributor 100 distributes the first baseband signal to the first positive frequency converting unit 231 and distributes the second baseband signal to the first negative frequency converting unit 211.

The first positive frequency converting unit 231 converts the first baseband signal into a positive frequency signal 1 corresponding to a first intermediate frequency $f_1$. The first baseband signal converted into the positive frequency signal 1 is illustrated in (a).

The first negative frequency converting unit 211 converts the second baseband signal into a negative frequency signal 2 corresponding to a first intermediate frequency $-f_2$. The second baseband signal converted into the negative frequency signal 2 is illustrated in (b).

The first positive frequency converting unit 231 and the first negative frequency converting unit 211 upconvert signals of different frequency bands to the lowest first intermediate frequency so that they do not overlap each other. The first intermediate frequency is to convert to the lowest frequency for conversion to the second center frequency, if the signal generator 11 cannot provide a direction conversion to a desired second intermediate frequency.

Herein, the positive frequency signal 1 and the negative frequency signal 2 are signals included in the same first IF band.

The rate matching unit 310 rate-matches the positive frequency signal 1 and the negative frequency signal 2 and outputs the resulting signals to the signal synthesizing unit 320.

The signal synthesizing unit 320 generates a signal of a first IF band by synthesizing the positive frequency signal 1 and the negative frequency signal 2 on the basis of a center frequency. The first IF band signal generated by synthesizing the positive frequency signal 1 and the negative frequency signal 2 is illustrated in (c).

The IF converting unit 330 converts the negative frequency signal 2 and the positive frequency signal 1 of the first IF band into a TX signal of the second IF band. Thus, the positive frequency signal 1 corresponds to the second intermediate frequency $f_{IF}$, and the negative frequency signal 2 corresponds to the second intermediate frequency $-f_{IF}$. The TX signal including the positive frequency signal 1 and the negative frequency signal 2 is a signal of the second IF band, which is illustrated in (d).

Figure 8:
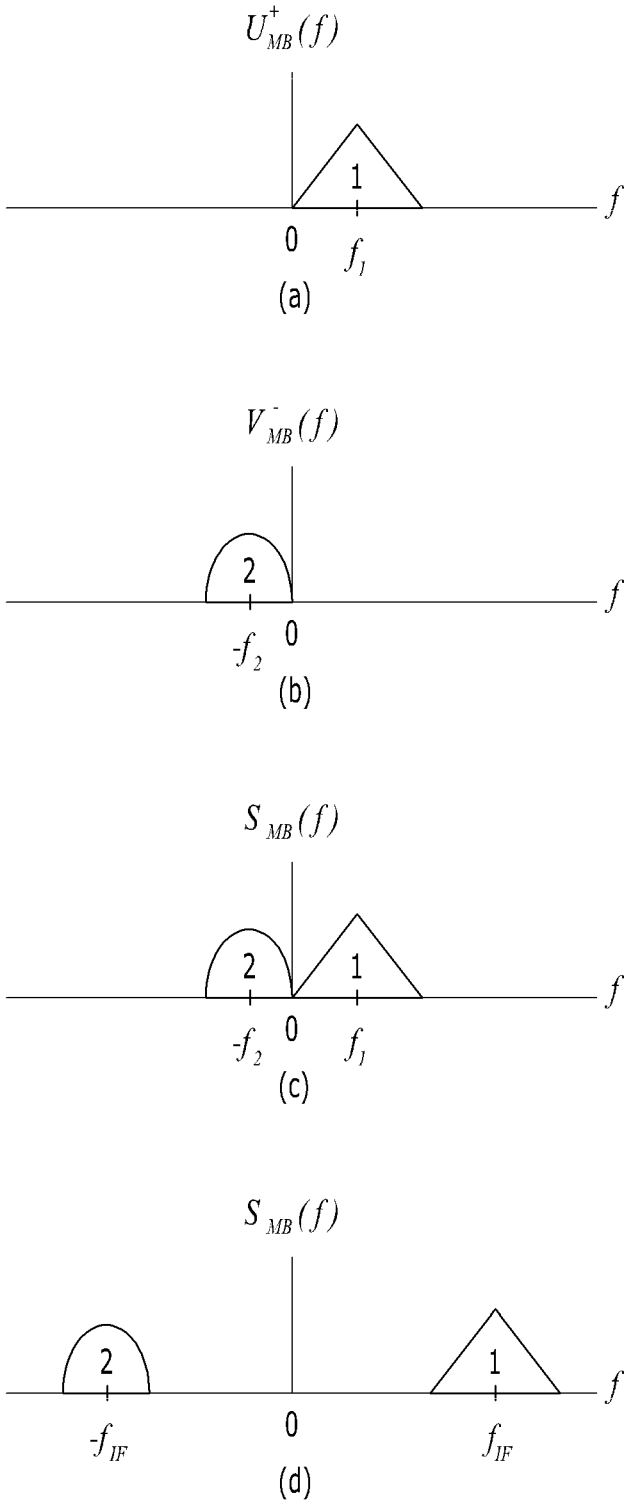
FIG. 8 is a block diagram of a signal generator in accordance with another exemplary embodiment of the present invention.

FIG. 8 is a block diagram of a signal generator 11 in accordance with another exemplary embodiment of the present invention.

Referring to FIG. 8, the signal generator 11 includes a signal distributor 100, a frequency converter 200, and a frequency synthesizer 300. The frequency converter 200 includes a negative frequency converting unit 210, a matching switch 220, and a positive frequency converting unit 230. The frequency synthesizer 300 includes a rate matching unit 310, a signal synthesizing unit 320, and an intermediate frequency (IF) converting unit 330.

In the signal generator 11, the signal distributer 100 transmits a signal through a center frequency region (a DC component) of an IF band as wall as a positive frequency region and a negative frequency region. To this end, the matching switch 220 provides a baseband signal, which is to be transmitted through the center frequency region, to the frequency synthesizer 300. Herein, the center frequency region is included in the IF band supported by the RF transmitter 12. The operation of the signal generator 11 using the center frequency region for TX signal generation will be described below in detail.

The signal distributor 100 receives baseband signals, and distributes the received baseband signals according to the respective frequency bands.

The frequency converter 200 allocates the respective baseband signals with different frequency bands to each of the positive frequency region and negative frequency region on the basis of one intermediate frequency, as described with reference to FIG. 3.

The negative frequency converting unit 210 generates a negative frequency signal from the baseband signal, distributed by the signal distributor 100, on the basis of a first intermediate frequency. The negative frequency converting unit 210 may include a first negative frequency converting unit 211 and a second negative frequency converting unit 212. The first negative frequency converting unit 211 and the second negative frequency converting unit 212 respectively generate negative frequency signals that do not overlap each other in the negative frequency domain.

The matching switch 220 provides a baseband signal to the frequency synthesizer 300 in order to use the center frequency. The matching switch 220 may provide the baseband signal to the frequency synthesizer 300 in response to a switch control signal SW_CTRL provided by a control unit in the transmitting apparatus 10.

Meanwhile, the matching switch 220 may also provide a baseband signal to the frequency synthesizer 300 in order to control the sampling rate between a plurality of baseband signals.

The positive frequency converting unit 230 generates a positive frequency signal from the baseband signal, distributed by the signal distributor 100, on the basis of a first intermediate frequency. The positive frequency converting unit 230 may include a first positive frequency converting unit 231 and a second positive frequency converting unit 232. The first positive frequency converting unit 231 and the second positive frequency converting unit 232 respectively generate positive frequency signals that do not overlap each other in the positive frequency domain.

The frequency synthesizer 300 synthesizes positive frequency signals and negative frequency signals to generate a transmission (TX) signal.

The rate matching unit 310 performs a rate matching operation between the negative frequency signal and the positive frequency signal that are respectively outputted from the negative frequency converting unit 210, the matching switch 220 and the positive frequency converting unit 230. The detailed operation of the rate matching unit 310 is the same as described with reference to FIG. 4, and thus a detailed description thereof will be omitted for conciseness.

The IF converting unit 330 may be selectively included in the frequency synthesizer 300, if necessary.

If the IF converting unit 330 is not included in the frequency synthesizer 300, the signal synthesizing unit 320 synthesizes the rate-matched signals to generate a TX signal. Herein, the TX signal is a signal of a predetermined IF band. The TX signal includes baseband signals of different frequency bands in each of the positive frequency domain and negative frequency domain. To this end, the IF converting unit 330 may convert the baseband signal, received through the matching switch 220, into an intermediate frequency signal of a center frequency region. As another example, a frequency conversion function of the center frequency region may be included in the frequency converter 200. The signal synthesizing unit 320 provides the generated TX signal to the RF transmitter 12.

On the other hand, if the IF converting unit 330 is included in the frequency synthesizer 300, the signal synthesizing unit 320 synthesizes the rate-matched signals to generate a signal of the first IF band. The signal synthesizing unit 320 provides the first IF band signal to the IF converting unit 330.

The IF converting unit 330 converts the first IF band signal into a signal of the second IF band. The IF converting unit 330 generates a TX signal converted to the second center frequency from the first center frequency signal. The IF converting unit 330 provides the generated TX signal to the RF transmitter 12.

Figure 9:
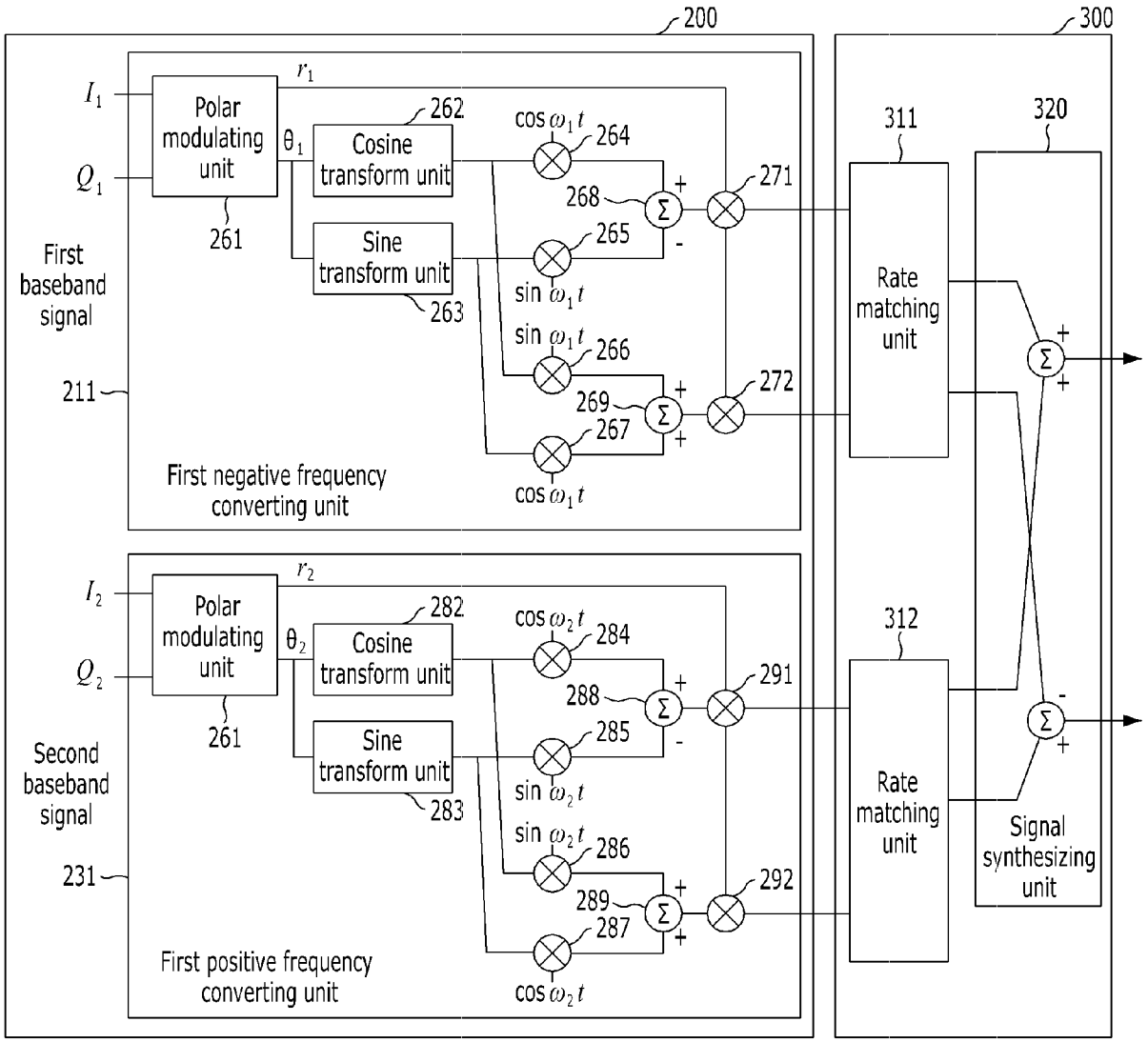
FIG. 9 is a diagram illustrating an example of TX signal generation according to the operation of the signal generator illustrated in FIG. 8.

FIG. 9 is a diagram illustrating an example of TX signal generation according to the operation of the signal generator 11 illustrated in FIG. 8.

Referring to FIG. 9, (*a*), (*b*), (*c*) and (*d*) illustrate that the signal generator 11 converts three baseband signals into one IF band and generates a transmission (TX) signal. In (a), (b), (c) and (d), the axis of abscissas represents a frequency f.

A TX signal generating operation will be described below on the basis of the signal generator 11 illustrated in FIG. 8.

The signal distributor 100 receives a first baseband signal, a second baseband signal, and a third baseband signal that have different frequency bands. The signal distributor 100 distributes the first baseband signal to the first positive frequency converting unit 231, switches the second baseband signal through the matching switch 220, and distributes the third baseband signal to the first negative frequency converting unit 211.

The first positive frequency converting unit 231 converts the first baseband signal into a positive frequency signal 1 corresponding to an intermediate frequency $f_{MB}$. The first baseband signal converted into the positive frequency signal 1 is illustrated in (a).

The matching switch 220 switches the second baseband signal for transmission through a center frequency region (a DC component). The second baseband signal is a signal 2 of the center frequency region corresponding to an intermediate frequency 0. The center frequency region signal 2 is illustrated in (b).

The first negative frequency converting unit 211 converts the third baseband signal into a negative frequency signal 3 corresponding to an intermediate frequency $-f_{MB}$. The third baseband signal converted into the negative frequency signal 3 is illustrated in (c).

Herein, the positive frequency signal 1, the center frequency signal 2, and the negative frequency signal 3 are signals included in one IF band.

The rate matching unit 310 rate-matches the positive frequency signal 1, the center frequency signal 2, and the negative frequency signal 3 and outputs the resulting signals to the signal synthesizing unit 320.

The signal synthesizing unit 320 generates a TX signal by synthesizing the positive frequency signal 1, the center frequency signal 2, and the negative frequency signal 3 on the basis of an intermediate frequency. The TX signal generated by synthesizing the positive frequency signal 1, the center frequency signal 2, and the negative frequency signal 3 is illustrated in (d).

Figure 10:
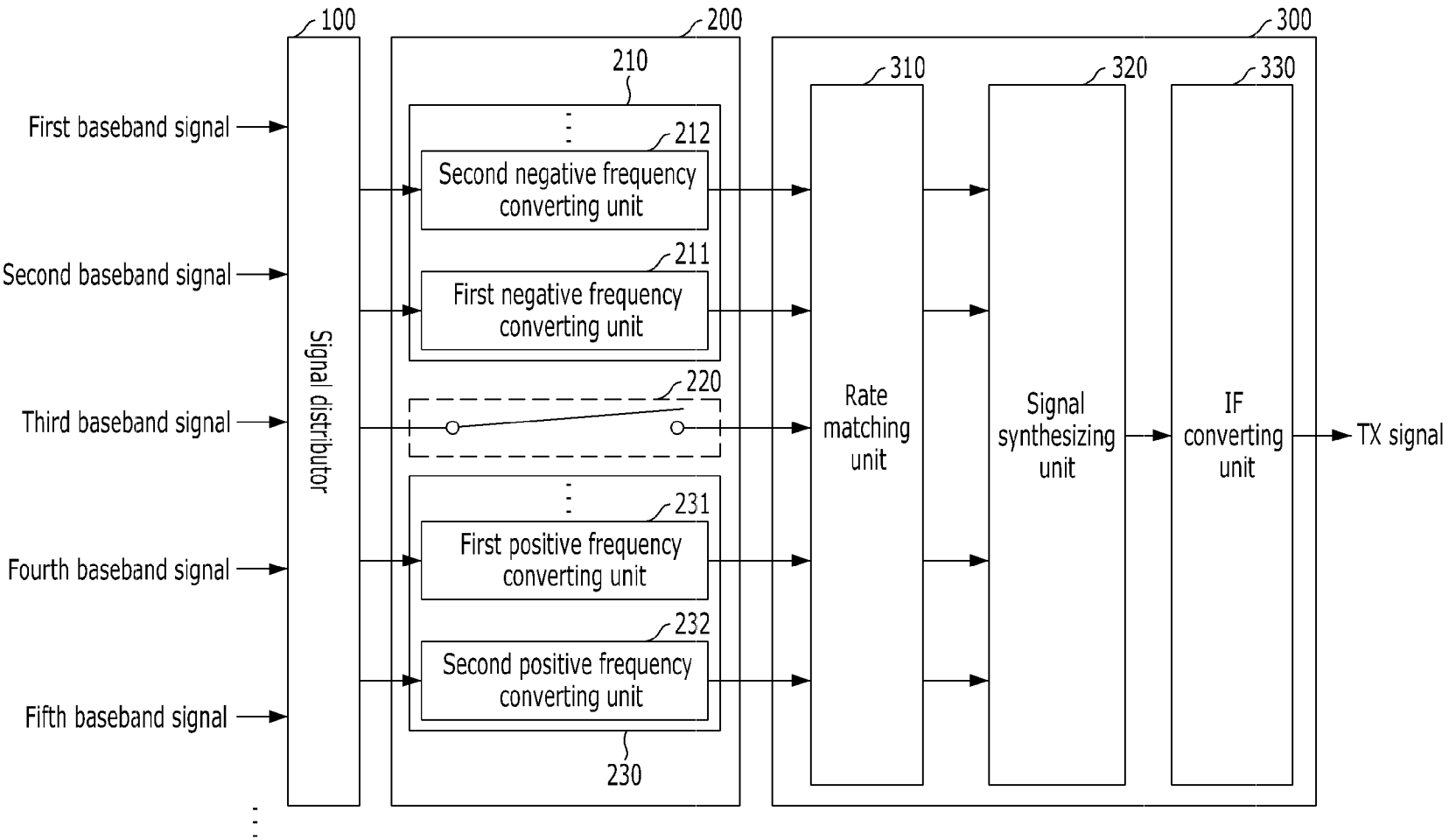
FIG. 10 is a block diagram of a signal generator in accordance with another exemplary embodiment of the present invention.

FIG. 10 is a block diagram of a signal generator 11 in accordance with another exemplary embodiment of the present invention.

Referring to FIG. 10, the signal generator 11 includes a signal distributor 100, a frequency converter 200, and a frequency synthesizer 300. The frequency converter 200 includes a negative frequency converting unit 210, a matching switch 220, and a positive frequency converting unit 230. The frequency synthesizer 300 includes a rate matching unit 310, a signal synthesizing unit 320, and an intermediate frequency (IF) converting unit 330.

The signal generator 11 may generate a TX signal by including one of a plurality of baseband signals in each of the positive frequency region and negative frequency region. Herein, the signal generator 11 generates the TX signal by including each of the other baseband signals in one of the positive frequency region and negative frequency region. To this end, the signal distributor 100 distributes one of the baseband signals to each of the negative frequency converting unit 210 and positive frequency converting unit 230.

The operation of the signal generator 11 for generating the TX signal by including one of the baseband signals in each of the positive frequency region and negative frequency region will be described below in detail.

The signal distributor 100 receives baseband signals. At this point, the signal distributor 100 selects one baseband signal to use both of the positive frequency region and the negative frequency region. The signal distributor 100 outputs the selected baseband signal to each of the negative frequency converting unit 210 and positive frequency converting unit 230 of the frequency converter 200. Also, the signal distributor 100 outputs the other baseband signals to one of the negative frequency converting unit 210 and positive frequency converting unit 230.

The frequency converter 200 allocates the baseband signals of different frequency bands to the positive frequency region and the negative frequency region on the basis of one intermediate frequency.

The negative frequency converting unit 210 generates a negative frequency signal from the baseband signal, distributed by the signal distributor 100, on the basis of one intermediate frequency. The negative frequency converting unit 210 may include a first negative frequency converting unit 211 and a second negative frequency converting unit 212. The first negative frequency converting unit 211 and the second negative frequency converting unit 212 respectively generate negative frequency signals that do not overlap each other in the negative frequency domain.

The matching switch 220 provides a baseband signal to the frequency synthesizer 300 in order to control the sampling rate between a plurality of baseband signals. The matching switch 220 may provide the baseband signal to the frequency synthesizer 300 in response to a switch control signal SW_CTRL provided by a control unit in the transmitting apparatus 10.

The positive frequency converting unit 230 generates a positive frequency signal from the baseband signal, distributed by the signal distributor 100, on the basis of one intermediate frequency. The positive frequency converting unit 230 may include a first positive frequency converting unit 231 and a second positive frequency converting unit 232. The first positive frequency converting unit 231 and the second positive frequency converting unit 232 respectively generate positive frequency signals that do not overlap each other in the positive frequency domain.

The frequency synthesizer 300 synthesizes positive frequency signals and negative frequency signals to generate a transmission (TX) signal.

The rate matching unit 310 performs a rate matching operation between the negative frequency signal and the positive frequency signal that are respectively outputted from the negative frequency converting unit 210 and the positive frequency converting unit 230. The detailed operation of the rate matching unit 310 is the same as described with reference to FIG. 4, and thus a detailed description thereof will be omitted for conciseness.

The IF converting unit 330 may be selectively included in the frequency synthesizer 300, if necessary.

If the IF converting unit 330 is not included in the frequency synthesizer 300, the signal synthesizing unit 320 synthesizes the rate-matched signals to generate a TX signal. Herein, the TX signal is a signal of a predetermined IF band. The TX signal includes baseband signals of different frequency bands in each of the positive frequency domain and negative frequency domain. To this end, the IF converting unit 330 may convert the baseband signal, received through the matching switch 220, into an intermediate frequency signal of a center frequency region. As another example, a frequency conversion function of the center frequency region may be included in the frequency converter 200. The signal synthesizing unit 320 provides the generated TX signal to the RF transmitter 12.

On the other hand, if the IF converting unit 330 is included in the frequency synthesizer 300, the signal synthesizing unit 320 synthesizes the rate-matched signals to generate a signal of the first IF band. The signal synthesizing unit 320 provides the first IF band signal to the IF converting unit 330.

The IF converting unit 330 converts the first IF band signal into a signal of the second IF band supported by the RF transmitter 12. The IF converting unit 330 generates a TX signal converted to the second center frequency from the first center frequency signal. The IF converting unit 330 provides the generated TX signal to the RF transmitter 12.

Figure 11:
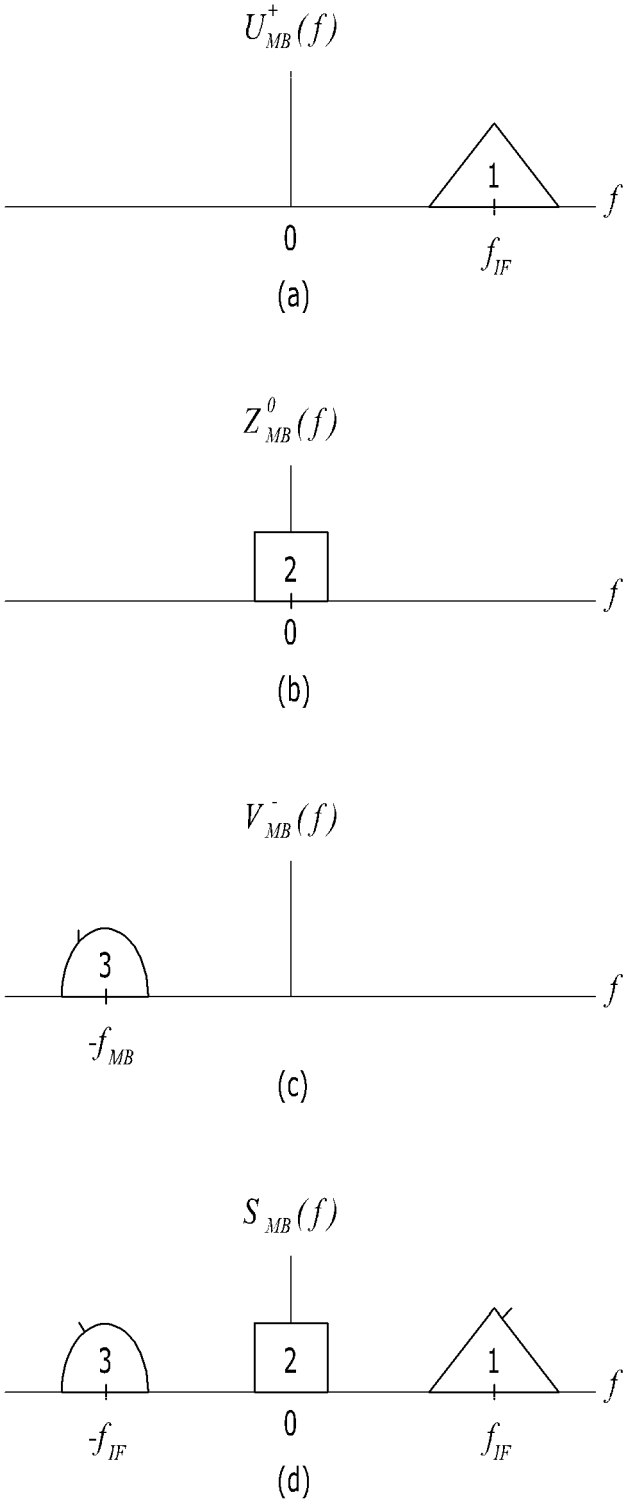
FIG. 11 is a diagram illustrating an example of TX signal generation according to the operation of the signal generator illustrated in FIG. 10.

FIG. 11 is a diagram illustrating an example of TX signal generation according to the operation of the signal generator 11 illustrated in FIG. 10.

Referring to FIG. 11, (*a*), (*b*), (*c*) and (*d*) illustrate that the signal generator 11 generates a TX signal by converting one of the baseband signals into one intermediate frequency region (i.e., included in the positive frequency region and the negative frequency region). In (a), (b), (c) and (d), the axis of abscissas represents a frequency f.

A TX signal generating operation will be described below on the basis of the signal generator 11 illustrated in FIG. 10.

The signal distributor 100 receives a first baseband signal, a second baseband signal, and a third baseband signal that have different frequency bands. The signal distributor 100 distributes the first baseband signal to the first positive frequency converting unit 231. The signal distributor 100 distributes the second baseband signal to the second positive frequency converting unit 232 and the first negative frequency converting unit 211. The signal distributor 100 distributes the third baseband signal to the second negative frequency converting unit 212.

The first positive frequency converting unit 231 converts the first baseband signal into a positive frequency signal 1 corresponding to an intermediate frequency $f_{MB}$. The first baseband signal converted into the positive frequency signal 1 is illustrated in (a).

The second positive frequency converting unit 232 converts the second baseband signal into a positive frequency signal 2A. The first negative frequency converting unit 211 converts the second baseband signal into a negative frequency signal 2B. The positive frequency signal 2A and the negative frequency signal 2B are converted so that they have a spectrum size of ½ in the positive frequency region and the negative frequency region on the basis of a center frequency (a DC component). The second baseband signal converted into the positive frequency signal 2A and the negative frequency signal 2B is illustrated in (b).

The second negative frequency converting unit 212 converts the third baseband signal into a negative frequency signal 3 corresponding to an intermediate frequency $-f_{MB}$. The third baseband signal converted into the negative frequency signal 3 is illustrated in (c).

Herein, the positive frequency signals 1 and 2A and the negative frequency signals 2B and 3 are signals included in one IF band.

The rate matching unit 310 rate-matches the positive frequency signals 1 and 2A and the negative frequency signals 2B and 3 and outputs the resulting signals to the signal synthesizing unit 320.

The signal synthesizing unit 320 generates a TX signal by synthesizing the positive frequency signal 1, the positive frequency signal 2A, the negative frequency signal 2B, and the negative frequency signal 3. The TX signal generated by synthesizing the positive frequency signal 1, the positive frequency signal 2A, the negative frequency signal 2B, and the negative frequency signal 3 is illustrated in (d).

Figure 12:
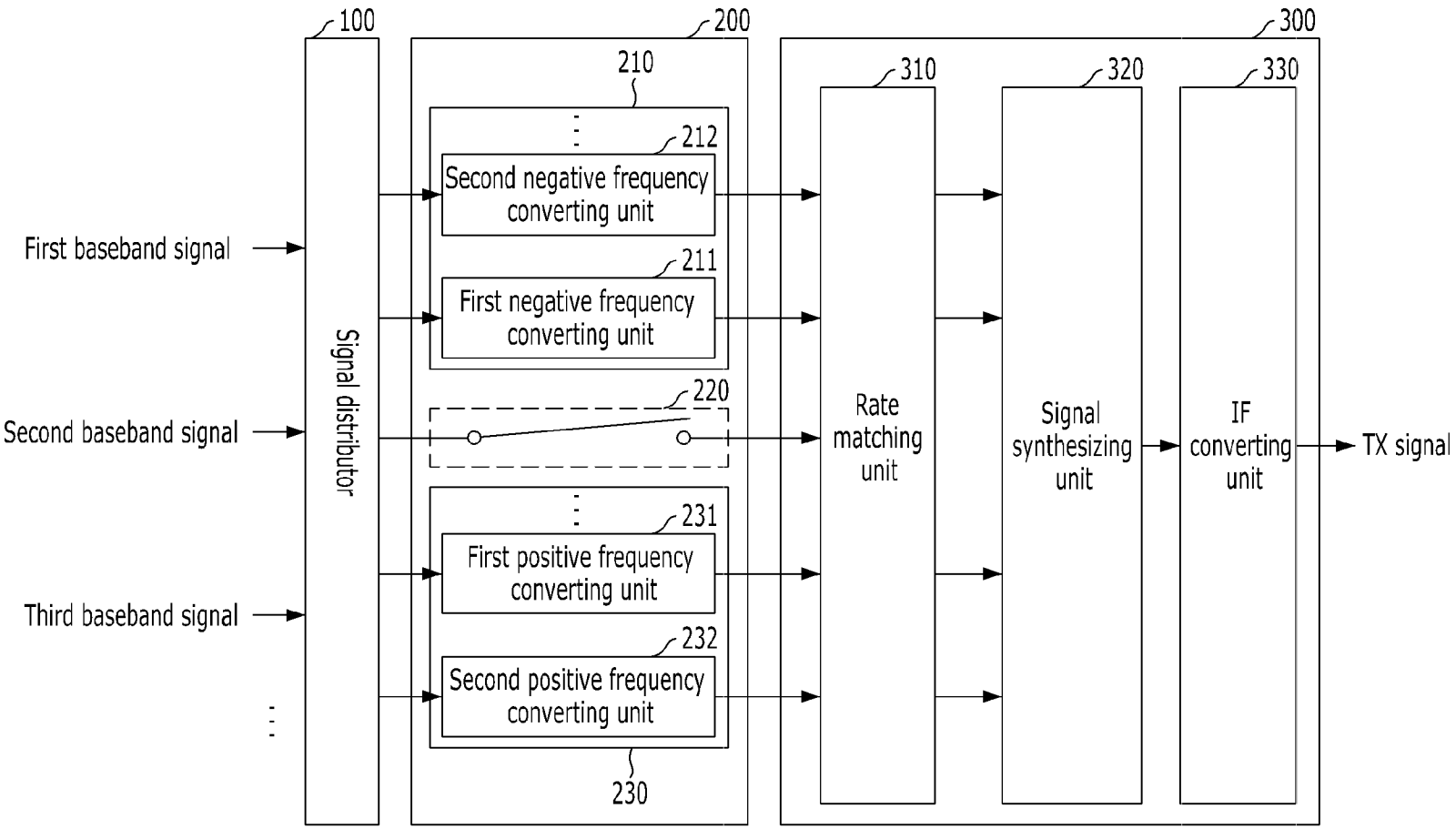
FIG. 12 is a block diagram of a signal generator in accordance with another exemplary embodiment of the present invention.

FIG. 12 is a block diagram of a signal generator 11 in accordance with another exemplary embodiment of the present invention.

Referring to FIG. 12, the signal generator 11 includes a signal distributor 100, a frequency converter 200, and a frequency synthesizer 300. The frequency converter 200 includes a negative frequency converting unit 210 and a positive frequency converting unit 230. The frequency synthesizer 300 includes a signal synthesizing unit 320.

The signal generator 11 may generate a TX signal by including one baseband signal in each of the positive frequency region and negative frequency region. The signal generator 11 may perform one baseband signal transmission, i.e., a single band transmission in order to reduce the sampling rate to ½.

The operation of the signal generator 11 for generating a TX signal by including one baseband signal in the positive frequency region and the negative frequency region will be described below in detail.

The signal distributor 100 receives one baseband signal. The signal distributor 100 outputs the received baseband signal to each of the negative frequency converting unit 210 and positive frequency converting unit 220.

The frequency converter 200 allocates the baseband signals of different frequency bands to the positive frequency region and the negative frequency region on the basis of one intermediate frequency.

The negative frequency converting unit 210 generates a negative frequency signal from the baseband signal, distributed by the signal distributor 100, on the basis of one intermediate frequency. The negative frequency converting unit 210 may include a first negative frequency converting unit 211 and a second negative frequency converting unit 212. The first negative frequency converting unit 211 and the second negative frequency converting unit 212 respectively generate negative frequency signals that do not overlap each other in the negative frequency domain.

The positive frequency converting unit 230 generates a positive frequency signal from the baseband signal, distributed by the signal distributor 100, on the basis of one intermediate frequency. The positive frequency converting unit 230 may include a first positive frequency converting unit 231 and a second positive frequency converting unit 232. The first positive frequency converting unit 231 and the second positive frequency converting unit 232 respectively generate positive frequency signals that do not overlap each other in the positive frequency domain.

The signal synthesizing unit 320 synthesizes positive frequency signals and negative frequency signals to generate a transmission (TX) signal. The frequency signal generated by the signal synthesizing unit 320 does not use a center frequency (DC) component.

The signal generator 11 in accordance with the embodiment of the present invention may be used before a single band transmission as illustrated in FIG. 12.

Figure 13:
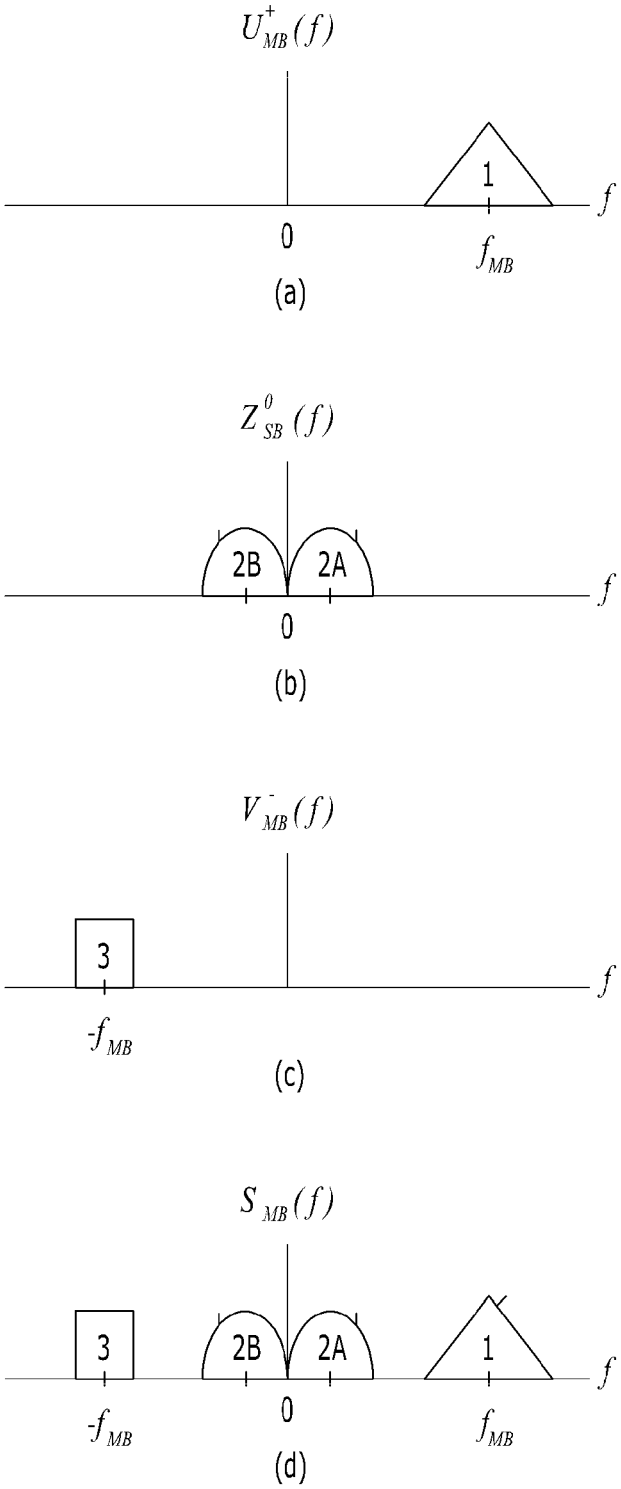
FIG. 13 is a diagram illustrating an example of TX signal generation according to the operation of the signal generator illustrated in FIG. 12.

FIG. 13 is a diagram illustrating an example of TX signal generation according to the operation of the signal generator 11 illustrated in FIG. 12.

Referring to FIG. 13, (*a*), (*b*), (*c*) and (*d*) illustrate that the signal generator 11 generates a TX signal by converting one of the baseband signals into one intermediate frequency region (i.e., included in the positive frequency region and the negative frequency region). In (a), (b), (c) and (d), the axis of abscissas represents a frequency f.

A TX signal generating operation will be described below on the basis of the signal generator 11 illustrated in FIG. 12.

The signal distributor 100 receives a first baseband signal. The signal distributor 100 distributes the first baseband signal to the first positive frequency converting unit 231 and the first negative frequency converting unit 211. The first baseband signal 1 received by the signal distributor 100 is illustrated in (a).

The first positive frequency converting unit 231 converts the first baseband signal into a positive frequency signal 1 corresponding to an intermediate frequency $f_{SB}$. The first baseband signal converted into the positive frequency signal 1A is illustrated in (b).

The first negative frequency converting unit 211 converts the first baseband signal into a negative frequency signal 1B corresponding to an intermediate frequency $-f_{SB}$. The first baseband signal converted into the negative frequency signal 1B is illustrated in (c).

Herein, the positive frequency signal 1A and the negative frequency signal 1B and are signals included in one IF band.

The signal synthesizing unit 320 generates a TX signal by synthesizing the positive frequency signal 1A and the negative frequency signal 1B. The TX signal generated by synthesizing the positive frequency signal 1A and the negative frequency signal 1B is illustrated in (d).

Hereinafter, the detailed structures of the frequency converter 200 and the frequency synthesizer 300 in the signal generator 11 will be described with reference to FIGS. 14 and 15. Herein, it is assumed that the signal generator 11 transmits signals of different frequency bands.

Figure 14:
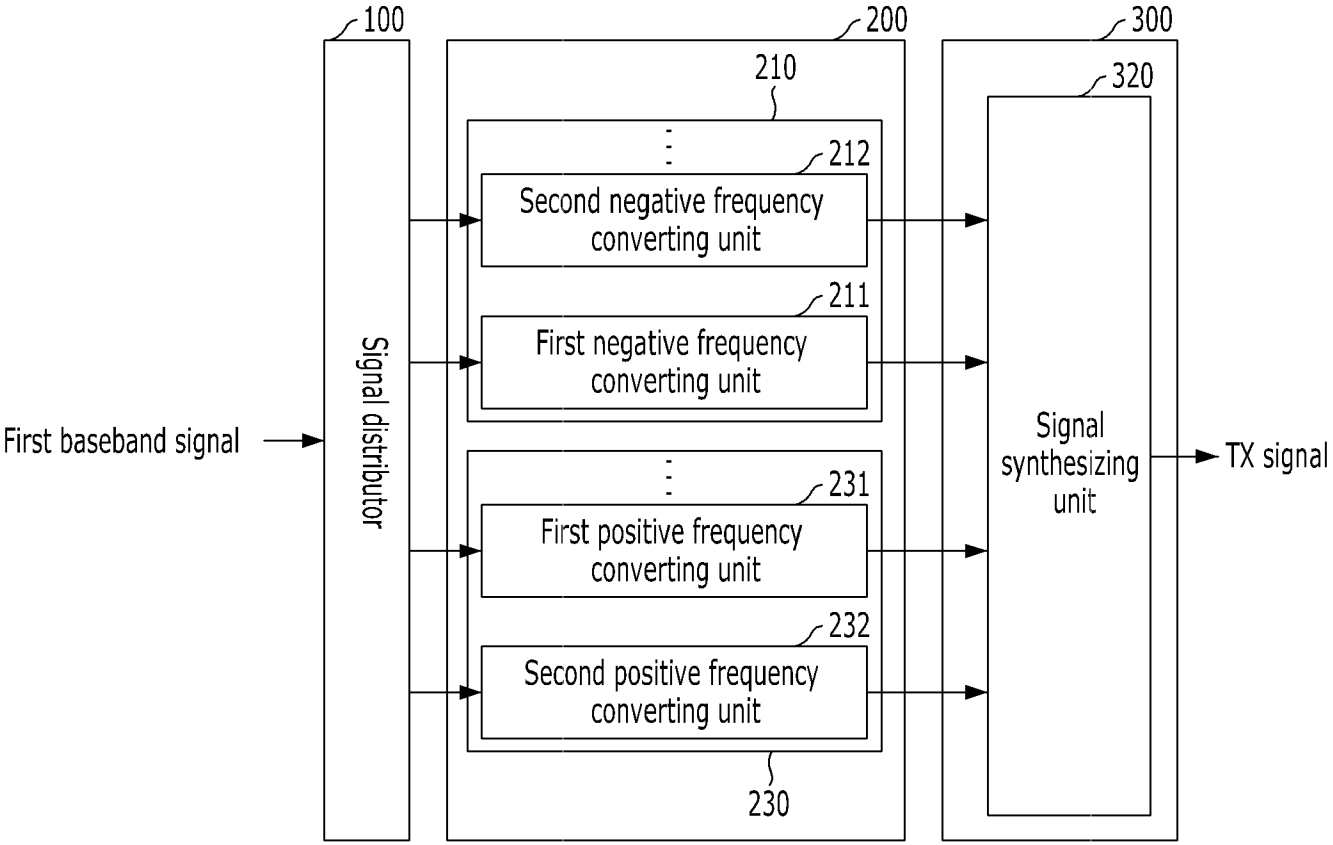
FIG. 14 is a diagram illustrating a frequency converter and a frequency synthesizer in accordance with an exemplary embodiment of the present invention.

FIG. 14 is a diagram illustrating a frequency converter 200 and a frequency synthesizer 300 in accordance with an exemplary embodiment of the present invention.

Referring to FIG. 14, the signal generator 11 includes a frequency converter 200 and a frequency synthesizer 300. The frequency converter 200 includes a first negative frequency converting unit 211 and a first positive frequency converting unit 231. A first baseband signal and a second baseband signal inputted into the frequency converter 200 are signals of different frequency bands.

The first negative frequency converting unit 211 includes multipliers 241, 242, 243 and 244 and combiners 245 and 246.

The first negative frequency converting unit 211 receives a first baseband signal. The first baseband signal includes a first in-phase signal $I_1$ and a first quadrature-phase signal $Q_1$.

The first multiplier 241 multiplies the first in-phase signal $I_1$ by a cosine signal $\cos w_1t$ for conversion to a first intermediate frequency (IF) band. The second multiplier 242 multiplies the first in-phase signal $I_1$ by a sine signal $\sin w_1t$ for conversion to the first IF band. The third multiplier 243 multiplies the first quadrature-phase signal $Q_1$ by a sine signal $\sin w_1t$ for conversion to the first IF band. The fourth multiplier 244 multiplies the first quadrature-phase signal $Q_1$ by a cosine signal $\cos w_1t$ for conversion to the first IF band.

The first combiner 245 subtracts the output signal of the third multiplier 243 from the output signal of the first multiplier 241 ($I_1 \cos w_1t - Q_1 \sin w_1t$). The second combiner 246 adds the output signal of the fourth multiplier 244 to the output signal of the second multiplier 242 ($I_1 \sin w_1t + Q_1 \cos w_1t$). The output of the first combiner 245 and the output of the second combiner 246 are provided to the frequency synthesizer 300.

Herein, the output of the first combiner 245 and the output of the second combiner 246 are negative frequency signals included in a negative frequency region. For example, the output of the first combiner 245 is a first negative frequency signal and the output of the second combiner 246 is a second negative frequency signal.

The first positive frequency converting unit 231 includes multipliers 251, 252, 253 and 254 and combiners 255 and 256.

The first positive frequency converting unit 231 receives a second baseband signal. The second baseband signal includes a second in-phase signal $I_2$ and a second quadrature-phase signal $Q_2$.

The fifth multiplier 251 multiplies the second in-phase signal $I_2$ by a cosine signal $\cos w_2t$ for conversion to a first intermediate frequency (IF) band. The sixth multiplier 252 multiplies the second in-phase signal $I_2$ by a sine signal $\sin w_2t$ for conversion to the first IF band. The seventh multiplier 253 multiplies the second quadrature-phase signal $Q_2$ by a sine signal $\sin w_2t$ for conversion to the first IF band. The eighth multiplier 254 multiplies the second quadrature-phase signal $Q_2$ by a cosine signal $\cos w_2t$ for conversion to the first IF band.

The third combiner 255 subtracts the output signal of the seventh multiplier 253 from the output signal of the fifth multiplier 251 ($I_2 \cos w_2t - Q_2 \sin w_2t$). The fourth combiner 256 adds the output signal of the eighth multiplier 254 to the output signal of the sixth multiplier 252 ($I_2 \cos w_2t + Q_2 \sin w_2t$). The output of the third combiner 255 and the output of the fourth combiner 256 are provided to the frequency synthesizer 300.

Herein, the output of the third combiner 255 and the output of the fourth combiner 256 are positive frequency signals included in a positive frequency region. For example, the output of the third combiner 255 is a first positive frequency signal and the output of the fourth combiner 256 is a second positive frequency signal.

The frequency synthesizer 300 includes a first rate matching unit 311, a second rate matching unit 312, a signal synthesizing unit 320, a first IF converting unit 331, and a second IF converting unit 332.

The first rate matching unit 311 performs a rate matching operation between the output signals (the first negative frequency signal and the second negative frequency signal) of the first negative frequency converting unit 211. The second rate matching unit 312 performs a rate matching operation between the output signals (the first positive frequency signal and the second positive frequency signal) of the first positive frequency converting unit 312.

The signal synthesizing unit 320 includes a fifth combiner 321 and a sixth combiner 322.

The fifth combiner 321 subtracts the first positive frequency signal outputted from the second rate matching unit 312, from the first negative frequency signal rate-matched from the first rate matching unit 311. The fifth combiner 321 outputs a first frequency synthesis signal.

The sixth combiner 322 subtracts the second positive frequency signal outputted from the second rate matching unit 312, from the second negative frequency signal rate-matched from the first rate matching unit 311. The sixth combiner 322 outputs a second frequency synthesis signal.

The first IF converting unit 331 multiplies the output signal (e.g., the first frequency synthesis signal) of the fifth combiner 321 by a sine signal $\sin w_{IF}t$ for conversion to the second IF band. For this multiplication operation, the first IF converting unit 331 may include a multiplier.

The second IF converting unit 332 multiplies the output signal (e.g., the second frequency synthesis signal) of the sixth combiner 322 by a cosine signal $\cos w_{IF}t$ for conversion to the second IF band. For this multiplication operation, the second IF converting unit 332 may include a multiplier.

The output signals of the frequency synthesizer 300 (the output signal of the first IF converting unit 331 and the output signal of the second IF converting unit 332) are signals of the second IF band. Also, for the output signals of the frequency synthesizer 300, the first baseband signal is allocated to a negative frequency region and the second baseband signal is allocated to a positive frequency region.

The structures of the frequency converter 200 and the frequency synthesizer 300 illustrated in FIG. 14 may be expressed as Equation 3.

$$v_-(t)=Re[v_1(t)]\cos w_bt-Im[v_1(t)]\sin w_bt-j\{Re[v_1(t)]\sin w_bt+Im[v_1(t)]\cos w_bt\}$$

$$u_+(t)=Re[u_1(t)]\cos w_bt-Im[u_1(t)]\sin w_bt-j\{Re[u_1(t)]\sin w_bt+Im[u_1(t)]\cos w_bt\} \quad \text{Eq. 3}$$

In Equation 3, $v_-(t)$ represents converting the first baseband signal into an intermediate frequency to leave only a negative frequency component, and $u_+(t)$ represents converting the second baseband signal into an intermediate frequency to leave only a positive frequency component. Thus, by Equation 3, the frequency converter 200 may convert the first baseband signal and the second baseband signal to the same IF band. The frequency converter 200 may convert the first baseband signal to the negative frequency region, and may convert the second baseband signal to the positive frequency region.

Thus, due to the operation described with reference to FIG. 14, the transmitting apparatus 10 in accordance with the embodiment of the present invention may use an RF transmitter that uses an oscillator using only one frequency band. That is, the transmitting apparatus 10 may use one RF transmitter 12.

Figure 15:
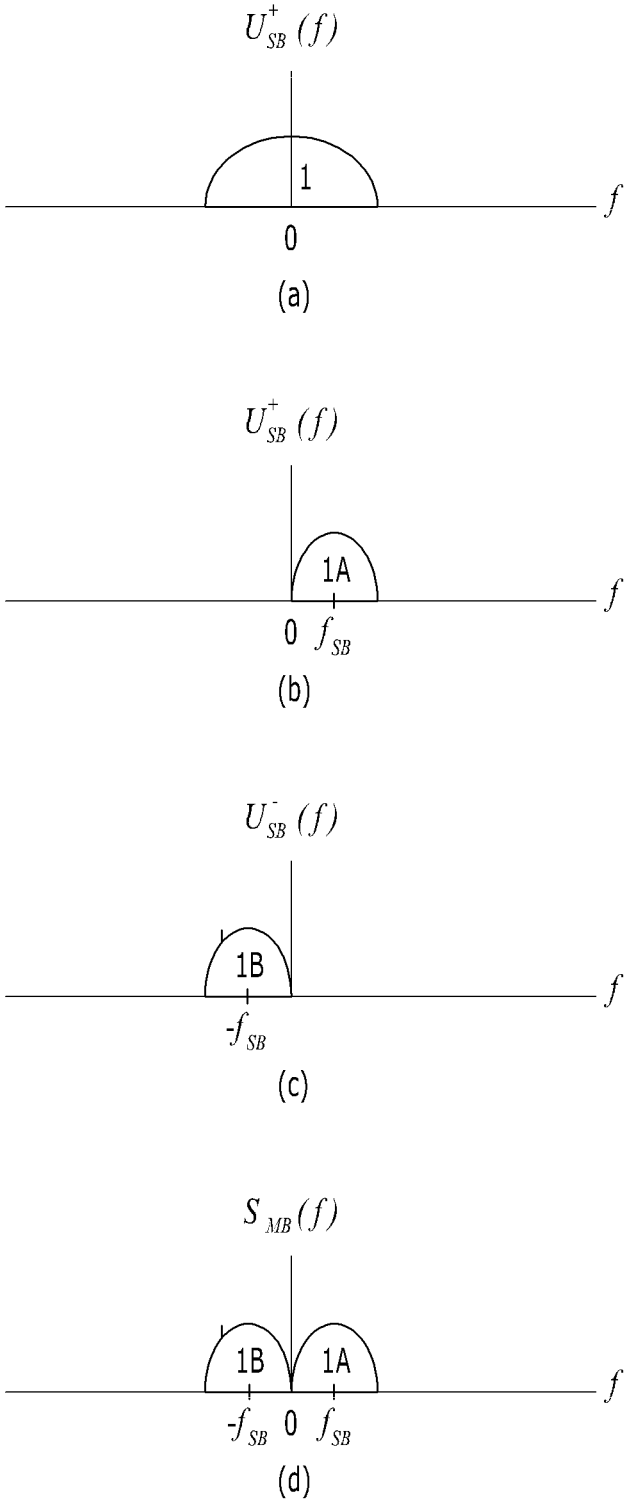
FIG. 15 is a diagram illustrating a frequency converter and a frequency synthesizer in accordance with another exemplary embodiment of the present invention.

FIG. 15 is a diagram illustrating a frequency converter 200 and a frequency synthesizer 300 in accordance with another exemplary embodiment of the present invention.

Referring to FIG. 15, the signal generator 11 includes a frequency converter 200 and a frequency synthesizer 300. The frequency converter 200 includes a first negative frequency converting unit 211 and a first positive frequency converting unit 231.

The first negative frequency converting unit 211 includes a first polar modulating unit 261, a first cosine transform unit 262, a first sine transform unit 263, multipliers 264, 265, 266, 267, 271 and 272, and combiners 268 and 269.

The first negative frequency converting unit 211 receives a first baseband signal. The first baseband signal includes a first in-phase signal $I_1$ and a first quadrature-phase signal $Q_1$.

The first polar modulating unit 261 generates a first amplitude signal $r_1$ and a first phase signal $\theta_1$ from the first in-phase signal $I_1$ and the first quadrature-phase signal $Q_1$ by polar modulation. The first polar modulating unit 261 converts a complex signal of the first baseband signal into a polar modulation signal.

The first cosine transform unit 262 generates a first cosine signal corresponding to the first phase signal $\theta_1$. The first cosine transform unit 262 may use a preset look-up table to generate the first cosine signal. The first cosine signal corresponding to the first phase signal is set in the look-up table.

The first sine transform unit 263 generates a first sine signal corresponding to the first phase signal $\theta_1$. The first sine transform unit 263 may use a preset look-up table to generate the first sine signal. The first sine signal corresponding to the first phase signal is set in the look-up table.

The first multiplier 264 multiplies the first cosine signal by a cosine signal $\cos w_1t$ for conversion to an intermediate frequency (IF) band. The second multiplier 265 multiplies the first cosine signal by a sine signal sin $w_1t$ for conversion to the IF band. The third multiplier 266 multiplies the first sine signal by a sine signal sin $w_1t$ for conversion to the IF band. The fourth multiplier 265 multiplies the first sine signal by a cosine signal cos $w_1t$ for conversion to the IF band.

The first combiner 268 subtracts the output signal of the third multiplier 266 from the output signal of the first multiplier 264. The second combiner 269 adds the output signal of the fourth multiplier 267 to the output signal of the second multiplier 265.

The fifth multiplier 271 multiplies the output signal of the first combiner 268 by the first amplitude signal $r_1$. The sixth multiplier 272 multiplies the output signal of the second combiner 269 by the first amplitude signal $r_1$.

Herein, the output of the fifth multiplier 271 and the output of the sixth multiplier 272 are negative frequency signals included in a negative frequency region. For example, the output of the fifth multiplier 271 is a first negative frequency signal and the output of the sixth multiplier 272 is a second negative frequency signal.

The output of the fifth multiplier 271 and the output of the sixth multiplier 272 are provided to the frequency synthesizer 300.

The second negative frequency converting unit 231 includes a second polar modulating unit 281, a second cosine transform unit 282, a second sine transform unit 283, multipliers 284, 285, 286, 287, 291 and 292, and combiners 288 and 289.

The first positive frequency converting unit 231 receives a second baseband signal. The second baseband signal includes a second in-phase signal $I_2$ and a second quadrature-phase signal $Q_2$.

The second polar modulating unit 281 generates a second amplitude signal $r_2$ and a second phase signal $\theta_2$ from the second in-phase signal $I_2$ and the second quadrature-phase signal $Q_2$ by polar modulation. The second polar modulating unit 281 converts a complex signal of the second baseband signal into a polar modulation signal.

The second cosine transform unit 282 generates a second cosine signal corresponding to the second phase signal $\theta_2$. The second cosine transform unit 282 may use a preset look-up table to generate the second cosine signal.

The second sine transform unit 283 generates a second sine signal corresponding to the second phase signal $\theta_2$. The second sine transform unit 283 may use a preset look-up table to generate the second sine signal.

The seventh multiplier 284 multiplies the second cosine signal by a cosine signal cos $w_2t$ for conversion to an intermediate frequency (IF) band. The eighth multiplier 285 multiplies the second cosine signal by a sine signal sin $w_2t$ for conversion to the IF band. The ninth multiplier 286 multiplies the second sine signal by a sine signal sin $w_2t$ for conversion to the IF band. The tenth multiplier 285 multiplies the second sine signal by a cosine signal cos $w_2t$ for conversion to the IF band.

The third combiner 288 subtracts the output signal of the ninth multiplier 286 from the output signal of the seventh multiplier 284. The fourth combiner 289 adds the output signal of the tenth multiplier 287 to the output signal of the eighth multiplier 285.

The eleventh multiplier 291 multiplies the output signal of the third combiner 288 by the second amplitude signal $r_2$. The twelfth multiplier 292 multiplies the output signal of the fourth combiner 289 by the second amplitude signal $r_2$.

Herein, the output of the eleventh multiplier 291 and the output of the twelfth multiplier 292 are positive frequency signals included in a positive frequency region. For example, the output of the eleventh multiplier 291 is a first positive frequency signal and the output of the twelfth multiplier 292 is a second positive frequency signal.

The output of the eleventh multiplier 291 and the output of the twelfth multiplier 292 are provided to the frequency synthesizer 300.

The frequency synthesizer 300 includes a first rate matching unit 311, a second rate matching unit 312, and a signal synthesizing unit 320.

The first rate matching unit 311 performs a rate matching operation between the output signals (the first negative frequency signal and the second negative frequency signal) of the first negative frequency converting unit 211. The second rate matching unit 312 performs a rate matching operation between the output signals (the first positive frequency signal and the second positive frequency signal) of the first positive frequency converting unit 312.

The signal synthesizing unit 320 includes a fifth combiner 321 and a sixth combiner 322.

The fifth combiner 321 adds the positive frequency signal outputted from the second rate matching unit 312, to the negative frequency signal outputted from the first rate matching unit 311.

The sixth combiner 322 subtracts the negative frequency signal outputted from the first rate matching unit 311, from the positive frequency signal outputted from the second rate matching unit 312.

The output signals of the frequency synthesizer 300 (the output signal of the fifth combiner 321 and the output signal of the sixth combiner 322) are signals of the second IF band. Also, for the output signals of the frequency synthesizer 300, the first baseband signal is allocated to the negative frequency region and the second baseband signal is allocated to the positive frequency region.

The baseband signals inputted into the frequency converter 200 of FIG. 15 may be expressed as Equation 4.

$$u_b(t)=a_u(t)\cos[w_bt+\theta_u(t)]$$

$$\hat{u}_b(t)=a_u(t)\sin[w_bt+\theta_u(t)]$$

The structures of the frequency converter 200 and the frequency synthesizer 300 illustrated in FIG. 15 may be expressed as Equation 5.

$$v_-(t)=a_v(t)\{\cos[w_bt+\theta_v(t)]-j\sin[w_bt+\theta_v(t)]\}$$

$$u_+(t)=a_u(t)\{\cos[w_bt+\theta_u(t)]-j\sin[w_bt+\theta_u(t)]\} \quad \text{Eq. 5}$$

In Equation 5, $v_-(t)$ represents converting the first baseband signal into an intermediate frequency to leave only a negative frequency component, and $u_+(t)$ represents converting the second baseband signal into an intermediate frequency to leave only a positive frequency component. Thus, by Equation 5, the frequency converter 200 may convert the first baseband signal and the second baseband signal to the same IF band. The frequency converter 200 may convert the first baseband signal to the negative frequency region, and may convert the second baseband signal to the positive frequency region.

Thus, due to the operation described with reference to FIG. 15, the transmitting apparatus 10 in accordance with the embodiment of the present invention may use an RF transmitter that uses an oscillator using only one frequency band. That is, the transmitting apparatus 10 may use one RF transmitter 12.

Figure 16:
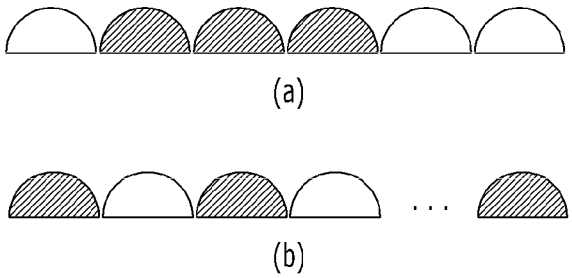
FIG. 16 is a diagram illustrating frequency band allocation of bandwidth aggregation.

FIG. 16 is a diagram illustrating frequency band allocation of bandwidth aggregation.

Referring to FIG. 16, bandwidth aggregation (or spectrum aggregation) is being discussed in the 3GPP LTE (3rd Generation Partnership Long Term Evolution), for example. The 3GPP LTE is considering a 100 MHz bandwidth to support a transmission rate of up to 1 Gbps.

(a) represents the frequency bandwidth of a continuous allocation of 100 MHz bands in the 3GPP LTE communication system. The allocated frequency band is represented by oblique lines.

However, it is not easy to allocate a bandwidth with a large size of 100 MHz continuously as represented by (a). Thus, the 3GPP LTE is discussing the supporting of a logically large bandwidth by combining distributed small bandwidths. That is, bandwidth aggregation means the supporting of a logically large bandwidth by combining a plurality of physically discontinuous bands.

(b) represents bandwidth aggregation that is used in the 3GPP LET communication system when a continuous allocation of 100 MHz bands is impossible. The allocated frequency band is represented by oblique lines.

Thus, a wireless communication system based on bandwidth aggregation needs to have RF transmitters that respectively support discontinuous frequency bands. However, the use of the transmitting apparatus 10 in accordance with the embodiment of the present invention makes it possible to transmit signals by one RF transmitter 12.

The transmitting apparatus 10 in accordance with the embodiment of the present invention can be used in wireless communication systems that use a bandwidth aggregation scheme as described above.

Figure 17:
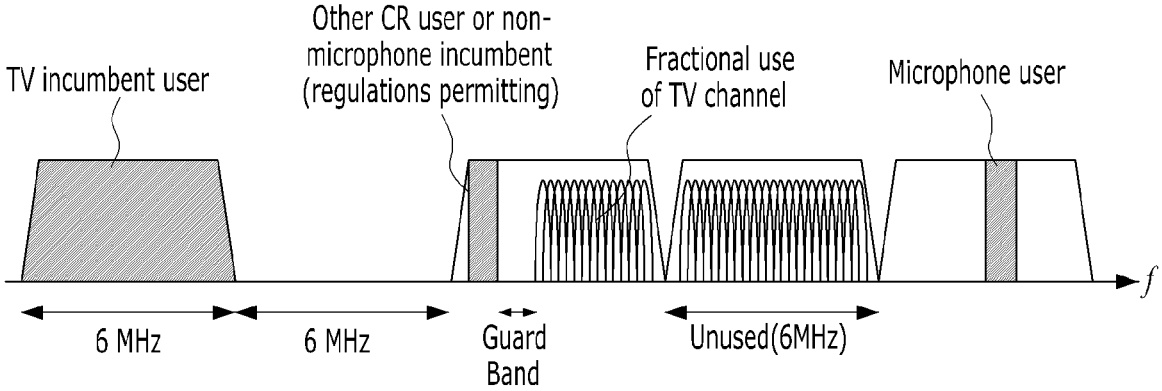
FIG. 17 is a diagram illustrating Cognitive Radio (CR) frequency bands.

FIG. 17 is a diagram illustrating cognitive radio (CR) frequency bands.

Referring to FIG. 17, a cognitive radio (CR) scheme means measuring a radio environment and determining the optimal communication scheme (the scheme for efficient use of free channels) suitable for the measured radio environment. For example, the IEEE 802.22 is considering a cognitive radio (CR) scheme for efficient use of free TV frequency bands (54-862 MHz). The axis of abscissas represents a frequency f.

A fractional bandwidth, which does not transmit data at the end of a band, may be used to minimize the interference in an adjacent channel caused by a transmitting apparatus using TV channels (i.e., a cognitive radio device).

Figure 18:
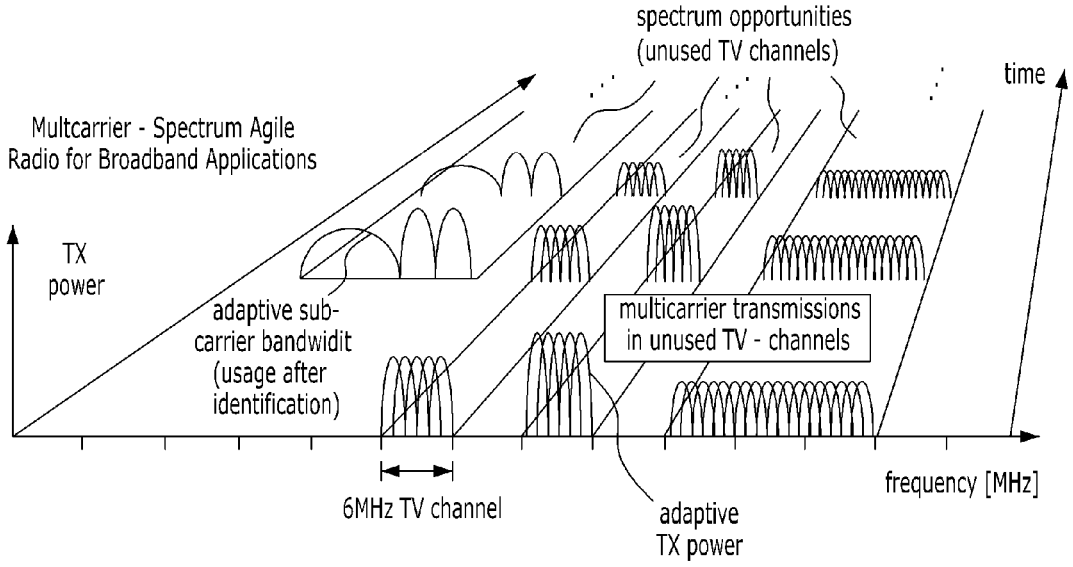
FIG. 18 is a diagram illustrating CR frequency shaping.

FIG. 18 is a diagram illustrating CR frequency shaping.

Referring to FIG. 18, it is illustrated that a transmitting apparatus using a cognitive radio scheme measures a free TV band and performs communication by shaping signals suitably for the free band.

The x-axis represents a frequency (MHz), the y-axis represents TX power, and the z-axis represents time. Free TV bands are illustrated.

A transmitting apparatus measures a free TV band, and uses a frequency band in such a way as to use the free band. The conventional transmitting apparatus must use a plurality of RF transmitters in order to transmit signals of discontinuous frequency bands. However, the use of the transmitting apparatus 10 in accordance with the embodiment of the present invention makes it possible to transmit signals by one RF transmitter 12.

The transmitting apparatus 10 in accordance with the embodiment of the present invention can be used in wireless communication systems that use a cognitive radio scheme as described above.

Figure 19:
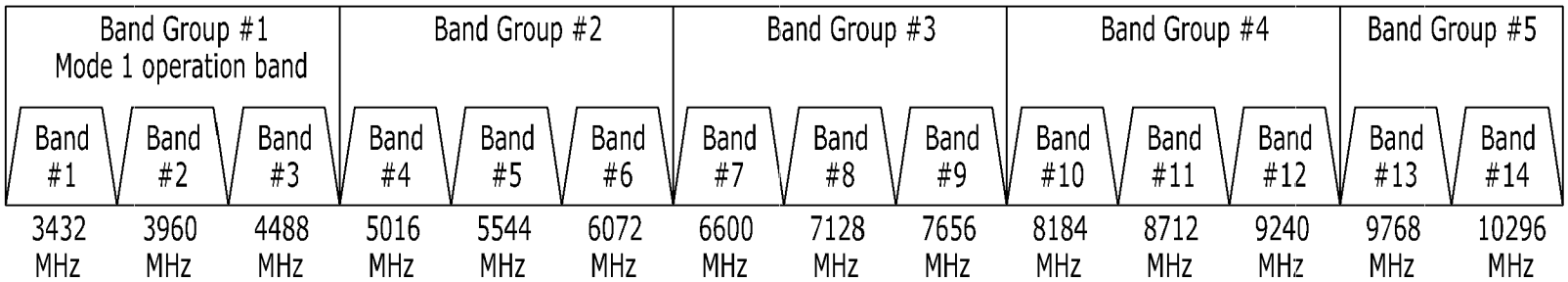
FIG. 19 is a diagram illustrating MB-OFDM (Multi-Band Orthogonal Frequency Division Multiplexing) frequency bands.

FIG. 19 is a diagram illustrating MB-OFDM (Multi-Band Orthogonal Frequency Division Multiplexing) frequency bands.

Referring to FIG. 19, an MB-OFDM (Multi Band-Orthogonal Frequency Division Multiplexing) scheme uses a frequency band of about 3.1 MHz to about 10.6 MHz. The OFDM scheme allocates 14 channels with a bandwidth of about 528 MHz for signal transmission and uses a subcarrier-based OFDM transmission scheme.

Five band groups of first to fifth band groups are illustrated. The first band group includes a first band with a center band of 3432 MHz, a second band with a center band of 3960 MHz, and a third band with a center band of 4488 MHz. The second band group includes a fourth band with a center band of 5016 MHz, a fifth band with a center band of 5544 MHz, and a sixth band with a center band of 6072 MHz. The third band group includes a seventh band with a center band of 6600 MHz, an eighth band with a center band of 7128 MHz, and a ninth band with a center band of 7576 MHz. The fourth band group includes a tenth band with a center band of 8184 MHz, an eleventh band with a center band of 8712 MHz, and a twelfth band with a center band of 9240 MHz. The fifth band group includes a thirteenth band with a center band of 9768 MHz and a fourteenth band with a center band of 10296 MHz.

Figure 20:
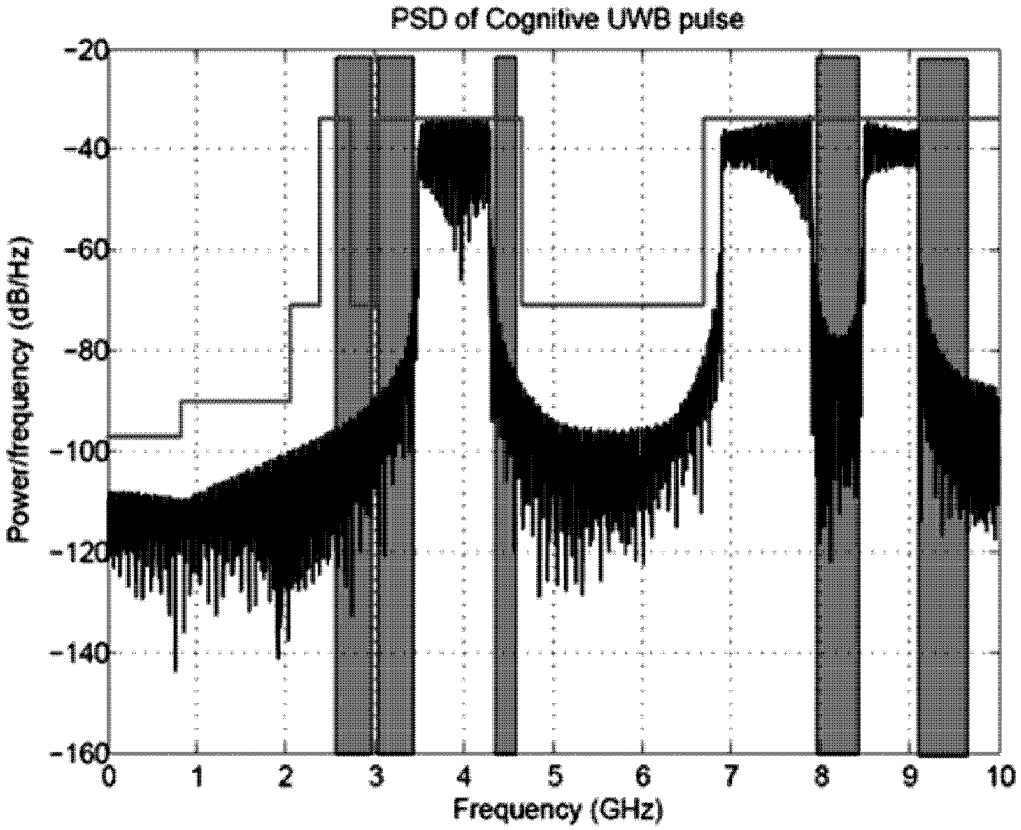
FIG. 20 is a diagram illustrating MB-OFDM frequency shaping.

FIG. 20 is a diagram illustrating MB-OFDM frequency shaping.

Referring to FIG. 20, a cognitive radio spectrum (a power spectral density (PSD)) in an MB-OFDM communication system is illustrated.

In the graph of FIG. 20, the axis of abscissas represents a frequency (GHz0, and the axis of ordinates represents a power/frequency ratio.

A free frequency region is present in a discontinuous multi-band signal. For example, frequency bands adjacent to 3 GHz, 4.5 GHz, 8.2 GHz and 9.4 GHz are free. The conventional transmitting apparatus needs a plurality of RF transmitters in order to use a free discontinuous frequency band. However, the use of the transmitting apparatus 10 in accordance with the embodiment of the present invention makes it possible to transmit signals by one RF transmitter.

The transmitting apparatus in accordance with the embodiment of the present invention can be used in MB-OFDM communication systems that use a cognitive radio scheme as described above.

FIGS. 16 to 20 illustrate radio environments where discontinuous frequency bands can be used between a transmitting apparatus and a receiving apparatus. In such radio environments, the transmitting apparatus in accordance with the embodiment of the present invention can transmit data by one RF transmitter even without using a plurality of RF transmitters.

To this end, the transmitting apparatus in accordance with the embodiment of the present invention performs transmission by including baseband signals corresponding to a plurality of frequency bands in an intermediate frequency band. Also, the transmitting apparatus in accordance with the embodiment of the present invention allocates baseband signals to each of the positive frequency region and negative frequency region of the intermediate frequency band.

Thus, the transmitting apparatus in accordance with the embodiment of the present invention can reduce the number of RF transmitters necessary to transmit a plurality of frequency band signals. Also, the transmitting apparatus in accordance with the embodiment of the present invention can reduce the sampling rate to ½ by using one of a positive frequency signal and a negative frequency signal on the basis of an intermediate frequency band. Also, the transmitting apparatus in accordance with the embodiment of the present invention can improve the signal transmission performance because it does not use a DC component if an error occurs due to the DC component of a frequency.

Examples of the transmitting apparatus in accordance with the embodiment of the present invention include wireless signal transmitting apparatuses such as base stations, relay stations, and mobile stations.

Also, a receiving apparatus corresponding to the transmitting apparatus in accordance with the embodiment of the present invention may be configured to have the structure corresponding to the above-described transmitting apparatus. In this case, the receiving apparatus may include one RF receiver for restoring a plurality of frequency band signals. If a signal restorer following the RF receiver can restore a plurality of baseband signals included in an intermediate frequency band, the receiving apparatus may use one RF receiver for signal reception.

In accordance with the exemplary embodiments of the present invention, the transmitting apparatus generates a plurality of frequency band signals as a TX signal of one predetermined intermediate frequency band, thus making it possible to transmit frequency band signals of different frequency bands by one RF transmitter. Also, the transmitting apparatus in accordance with the embodiment of the present invention can reduce the number of RF transmitters necessary to transmit a plurality of frequency band signals.

While the present invention has been described with respect to the specific embodiments, it will be apparent to those skilled in the art that various changes and modifications may be made without departing from the spirit and scope of the invention as defined in the following claims.

What is claimed is:

1. A signal transmitting apparatus comprising:

a signal distributor configured to distribute baseband signals corresponding respectively to a plurality of frequency bands;

a frequency converter configured to convert each of the distributed baseband signals into one of a positive frequency signal and a negative frequency signal according to the frequency band; and a frequency synthesizer configured to synthesize the positive frequency signals and the negative frequency signals outputted from the frequency converter to generate a transmission signal, wherein the positive frequency signals and the negative frequency signals are signals included in one predetermined intermediate frequency band, wherein the frequency converter comprises a positive frequency converting unit configured to convert a portion of the distributed baseband signals into positive frequency signals included in a positive frequency region, and a negative frequency converting unit configured to convert the other portion of the distributed baseband signals into negative frequency signals included in a negative frequency region, wherein the signal distributor selects and distributes one of the baseband signals, wherein the frequency converter further comprises a switch configured to provide the selected baseband signal to the frequency synthesizer, and wherein the frequency synthesizer comprises a signal synthesizing unit configured to convert a provided baseband signal into a center frequency signal included in a center frequency region and to synthesize the positive frequency signals, the center frequency signal and the negative frequency signals, and an intermediate frequency converting unit configured to convert the positive frequency signals, the center frequency signal and the negative frequency signals to a second intermediate frequency region different from the intermediate frequency band, wherein the center frequency signal is included in the intermediate frequency band.

2. The signal transmitting apparatus of claim 1, further comprising a radio transmitter configured to convert the transmission signal into a radio signal prior to transmission, wherein the radio transmitter supports the transmission of a signal of the intermediate frequency band.

3. The signal transmitting apparatus of claim 1, wherein the frequency synthesizer comprises:

a signal synthesizing unit configured to synthesize the positive frequency signals and the negative frequency signals; and an intermediate frequency converting unit configured to convert the positive frequency signals and the negative frequency signals to a second intermediate frequency region different from the intermediate frequency region.

4. The signal transmitting apparatus of claim 3, further comprising a radio transmitter configured to convert the transmission signal into a radio signal prior to transmission, wherein the radio transmitter supports the transmission of a signal of the second intermediate frequency band.

5. The signal transmitting apparatus of claim 1, wherein the signal distributor distributes each of the baseband signals to one of the positive frequency converting unit and the negative frequency converting unit.

6. A signal transmitting apparatus comprising:

a negative frequency signal generating unit configured to generate a first baseband signal as a first negative frequency signal and a second negative frequency signal by operation with a first sine signal and a first cosine signal for conversion to a negative frequency region signal of an intermediate frequency band;

a positive frequency signal generating unit configured to generate a second baseband signal as a first positive frequency signal and a second positive frequency signal by operation with a second sine signal and a second cosine signal for conversion to a positive frequency region signal of an intermediate frequency band;

a rate matching unit configured to rate-match each of the first and second negative frequency signals and to rate-match each of the first and second positive frequency signals;

a signal combining unit configured to generate a first frequency synthesis signal by subtracting the rate-matched first positive frequency signal from the rate-matched first negative frequency signal, and to generate a second frequency synthesis signal by adding the rate-matched second positive frequency signal to the rate-matched second negative frequency signal; and an intermediate frequency converting unit configured to generate a first intermediate frequency signal by multiplying the first frequency synthesis signal by a third sine signal for conversion to a signal of a second intermediate frequency band different from the intermediate frequency band, and to generate a second intermediate frequency signal by multiplying the first frequency synthesis signal by a third cosine signal, wherein the first baseband signal and the second baseband signal are signals of different frequency bands.

7. The signal transmitting apparatus of claim 6, wherein the negative frequency signal generating unit comprises:

first multipliers configured to multiply a first in-phase signal of a first baseband signal respectively by a first cosine signal and a first sine signal;

second multipliers configured to multiply a first quadrature-phase signal of the first baseband signal respectively by the first sine signal and the first cosine signal;

a first combiner configured to generate a first negative frequency signal by subtracting the first quadrature-phase signal multiplied by the first sine signal from the first in-phase signal multiplied by the first cosine signal; and a second combiner configured to generate a second negative frequency signal by adding the first in-phase signal multiplied by the first sine signal and the first quadrature-phase signal multiplied by the first cosine signal.

8. The signal transmitting apparatus of claim 7, wherein the negative frequency signal generating unit comprises:

third multipliers configured to multiply a second in-phase signal of a second baseband signal respectively by a second cosine signal and a second sine signal;

fourth multipliers configured to multiply a second quadrature-phase signal of the second baseband signal respectively by the second sine signal and the second cosine signal;

a third combiner configured to generate a first positive frequency signal by subtracting the second quadrature-phase signal multiplied by the second sine signal from the second in-phase signal multiplied by the second cosine signal; and a fourth combiner configured to generate a second positive frequency signal by adding the second in-phase signal multiplied by the second sine signal and the second quadrature-phase signal multiplied by the second cosine signal.

9. A signal transmitting apparatus comprising:

a negative frequency signal generating unit configured to generate a first baseband signal as a first negative frequency signal and a second negative frequency signal by operation with a first sine signal and a first cosine signal for conversion to a negative frequency region signal of an intermediate frequency band;

a positive frequency signal generating unit configured to generate a second baseband signal as a first positive frequency signal and a second positive frequency signal by operation with a second sine signal and a second cosine signal for conversion to a positive frequency region signal of an intermediate frequency band;

a rate matching unit configured to rate-match each of the first and second negative frequency signals and to rate-match each of the first and second positive frequency signals; and a signal combining unit configured to generate a first frequency synthesis signal by adding the rate-matched first positive frequency signal to the rate-matched first negative frequency signal, and to generate a second frequency synthesis signal by subtracting the rate-matched second positive frequency signal from the rate-matched second negative frequency signal, wherein the first baseband signal and the second baseband signal are signals of different frequency bands.

10. The signal transmitting apparatus of claim 9, wherein the negative frequency signal generating unit comprises:

a first polar modulating unit configured to generate a first amplitude signal and a first phase signal by polar-modulating a first in-phase signal of a first baseband signal and a first quadrature-phase signal;

a first cosine transform unit configured to transform the first phase signal into a first cosine signal;

a first sine transform unit configured to transform the first phase signal into a first sine signal;

first multipliers configured to multiply the first cosine signal respectively by a second cosine signal and a second sine signal;

second multipliers configured to multiply the first sine signal respectively by the second sine signal and the second cosine signal;

a first combiner configured to subtract the first cosine signal multiplied by the second sine signal from the first cosine signal multiplied by the second sine signal;

a second combiner configured to add the first sine signal multiplied by the second cosine signal to the first sine signal multiplied by the second sine signal;

a first multiplier configured to generate a first negative frequency signal by multiplying the output signal of the first combiner by the first amplitude signal; and a second multiplier configured to generate a second negative frequency signal by multiplying the output signal of the second combiner by the first amplitude signal.

11. The signal transmitting apparatus of claim 10, wherein the positive frequency signal generating unit comprises:

a second polar modulating unit configured to generate a second amplitude signal and a second phase signal by polar-modulating a second in-phase signal of a second baseband signal and a second quadrature-phase signal;

a second cosine transform unit configured to transform the second phase signal into a third cosine signal;

a second sine transform unit configured to transform the second phase signal into a third sine signal;

third multipliers configured to multiply the third cosine signal respectively by a fourth cosine signal and a fourth sine signal;

fourth multipliers configured to multiply the third sine signal respectively by the fourth sine signal and the fourth cosine signal;

a third combiner configured to subtract the third cosine signal multiplied by the fourth sine signal from the third cosine signal multiplied by the fourth cosine signal;

a fourth combiner configured to add the third sine signal multiplied by the fourth cosine signal to the third sine signal multiplied by the fourth sine signal;

a third multiplier configured to generate a first positive frequency signal by multiplying the output signal of the fourth combiner by the second amplitude signal; and a fourth multiplier configured to generate a second positive frequency signal by multiplying the output signal of the second combiner by the second amplitude signal.

* * * * *